US011905488B2

(12) United States Patent
Cunningham et al.

(10) Patent No.: US 11,905,488 B2
(45) Date of Patent: Feb. 20, 2024

(54) TRANSMISSION FLUID COMPOSITIONS FOR HYBRID AND ELECTRIC VEHICLE APPLICATIONS

(71) Applicant: Infineum International Limited, Abingdon (GB)

(72) Inventors: Matthew Cunningham, Reading (GB); Maria C. Chiappelli, Eastchester, NY (US); Joe R. Noles, Jr., Belle Mead, NJ (US); Kerry L. Cogen, Flemington, NJ (US); Keith R. Gorda, Little York, NJ (US); Hahnsoo Kim, Basking Ridge, NJ (US); Raymond F. Watts, Long Valley, NJ (US); Laura A. Kahsar, Lexington, KY (US)

(73) Assignee: Infineum International Limited, Abingdon (GB)

( * ) Notice: Subject to any disclaimer, the term of this patent is extended or adjusted under 35 U.S.C. 154(b) by 0 days.

(21) Appl. No.: 17/072,398

(22) Filed: Oct. 16, 2020

(65) Prior Publication Data

US 2022/0119727 A1 Apr. 21, 2022

(51) Int. Cl.

| | |
|---|---|
| ***C10M 137/04*** | (2006.01) |
| ***C10M 169/04*** | (2006.01) |
| ***C10M 129/72*** | (2006.01) |
| ***C10M 133/44*** | (2006.01) |
| ***C10M 135/24*** | (2006.01) |
| *C10N 40/04* | (2006.01) |
| *C10N 30/00* | (2006.01) |
| *C10N 10/04* | (2006.01) |
| *C10N 20/02* | (2006.01) |
| *C10N 30/04* | (2006.01) |
| *C10N 30/06* | (2006.01) |

(52) U.S. Cl.

CPC ..... *C10M 169/04* (2013.01); *C10M 129/72* (2013.01); *C10M 133/44* (2013.01); *C10M 135/24* (2013.01); *C10M 137/04* (2013.01); *C10N 2010/04* (2013.01); *C10N 2020/02* (2013.01); *C10N 2030/04* (2013.01); *C10N 2030/06* (2013.01); *C10N 2030/45* (2020.05); *C10N 2040/042* (2020.05)

(58) Field of Classification Search

CPC ..... C10M 137/04; C10M 2223/04; C10M 135/22; C10M 135/20

See application file for complete search history.

(56) References Cited

U.S. PATENT DOCUMENTS

| | | | | |
|---|---|---|---|---|
| 2,719,125 | A | 9/1955 | Roberts | |
| 2,719,126 | A | 9/1955 | Fields et al. | |
| 2,760,933 | A | 8/1956 | Fields et al. | |
| 2,836,564 | A | 5/1958 | Roberts et al. | |
| 3,087,937 | A | 4/1963 | Tesi et al. | |
| 3,254,025 | A | 5/1966 | Le Suer | |
| 3,502,677 | A | 3/1970 | Le Suer | |
| 3,663,561 | A | 5/1972 | Blaha | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,622 | A | 8/1981 | deVries et al. | |
| 4,285,822 | A | 8/1981 | deVries et al. | |
| 4,857,214 | A | 8/1989 | Papay et al. | |
| 4,873,009 | A | 10/1989 | Anderson | |
| 5,561,103 | A | 10/1996 | Tipton | |
| 5,840,663 | A * | 11/1998 | Nibert | C10M 141/10 508/279 |
| 5,916,852 | A * | 6/1999 | Nibert | C10M 133/52 508/432 |
| 6,060,437 | A * | 5/2000 | Robson | C10M 159/24 508/371 |
| 11,312,918 | B2 * | 4/2022 | Schwaebisch | C10M 135/20 |
| 2006/0148663 | A1 * | 7/2006 | Shimizu | C10M 135/26 508/465 |
| 2009/0005277 | A1 * | 1/2009 | Watts | C10M 169/048 508/283 |
| 2009/0082233 | A1 * | 3/2009 | Kasai | C10M 163/00 508/174 |
| 2012/0238481 | A1 * | 9/2012 | Kamano | C10M 141/08 508/509 |
| 2012/0264665 | A1 | 10/2012 | Wu et al. | |
| 2015/0275129 | A1 | 10/2015 | Patil et al. | |
| 2017/0015931 | A1 * | 1/2017 | Watts | F16D 13/74 |

(Continued)

FOREIGN PATENT DOCUMENTS

| | | | |
|---|---|---|---|
| EP | 3118285 | A1 | 1/2017 |
| EP | 3674385 | A1 | 1/2020 |

(Continued)

OTHER PUBLICATIONS

American Petroleum Institute, "Engine Oil Licensing and Certification System", API 1509, Industry Services Dept., Fourteenth Edition, Dec. 1996, Addendum 1, Dec. 1998.

(Continued)

*Primary Examiner* — Ellen M McAvoy

(57) ABSTRACT

A transmission fluid composition contains a major amount of a lubricating oil basestock, and a minor amount of an additive package comprising: (i) a mixture comprising two or more phosphites and/or phosphates; (ii) one or more thioester compounds; (iii) a detergent comprising calcium salicylate; and (iv) a poly(alkylene amine)-based ashless dispersant endcapped with metallocene-catalyzed PAO arms. Such a transmission fluid may be used for controlling/reducing wear in at least partially electrically-powered transmissions and/or for cooling/insulating electrical/electronic components of at least partially electrically-powered drivetrains.

25 Claims, No Drawings

(56) References Cited

U.S. PATENT DOCUMENTS

| | | | | |
|---|---|---|---|---|
| 2018/0023019 | A1* | 1/2018 | Guiducci | C10M 169/04 508/186 |
| 2021/0122994 | A1* | 4/2021 | Fang | C10M 141/12 |
| 2021/0292676 | A1* | 9/2021 | Kubo | C10M 137/08 |

FOREIGN PATENT DOCUMENTS

| | | | |
|---|---|---|---|
| EP | 3878930 | A1 | 9/2021 |
| WO | 9406897 | A1 | 3/1994 |
| WO | 2020/095970 | A1 | 5/2020 |

OTHER PUBLICATIONS

C.V. Smallheer et al., "Lubricant Additive", The Lexius-Hiles Co., Cleveland, Ohio, 1967, pp. 1-11.
European Search Report Application No. EP220331.
Supplemental European Search Report Application No. 21198678.1.

* cited by examiner

TRANSMISSION FLUID COMPOSITIONS FOR HYBRID AND ELECTRIC VEHICLE APPLICATIONS

FIELD

This disclosure relates to lubricant compositions, such as those for hybrid and fully electric vehicle applications. The lubricants may provide lubrication to the contacting mechanical parts of an engine and/or transmission, while also providing the necessary cooling and electrical resistance properties when contacting the electrical/electronic portions of the engine and/or transmission.

BACKGROUND

As part of the continuing drive towards improved vehicle efficiency and reduced environmental impact, vehicle manufacturers are developing so-called 'hybrid vehicles.' These are vehicles such as automobiles and larger vehicles which have two means of propulsion, for example a combustion engine, either gasoline or diesel-fueled, and an electric motor which is driven by batteries. The batteries may either be charged using the combustion engine, by regenerative braking, or by both.

Hybrid vehicles can include conventional stepped automatic transmissions, continuously variable transmissions, or other common types of transmission. In one particular type of transmission, herein referred to as a 'hybrid transmission', electromechanical parts such as electric motors and mechanical parts such as reduction gears and drive gears are housed within a single housing and lubricated by a common lubricant. An example of such a hybrid transmission is the Electronically-controlled Continuously Variable Transmission, or ECVT, which is used by Toyota in its hybrid vehicles. Other vehicle manufacturers use similar devices. To the extent that fully electric vehicle transmissions may also have mechanical parts housed within the same housing as electric/electromechanical parts, the common lubricant in such vehicles can have similar requirements. Thus, it is to the lubrication of at least partially electric (e.g., hybrid and/or fully electric) transmissions that the present disclosure is concerned.

The nature of a hybrid or fully electric transmission places several different demands on the transmission fluid used in its lubrication. The mechanical parts, gears etc., must be adequately protected from wear and corrosion just as in any conventional transmission. However, the presence of electromechanical components means that the transmission fluid must also provide electrical insulation (or sufficiently high volume resistivity), good compatibility with metals present in electromechanical components (commonly copper), and good cooling ability. Additionally, for reasons of improved efficiency in terms of energy (fuel) consumption, it can be desirable that the transmission fluid used may reduce/minimize the energy losses due to drag and friction in the fluid itself. Lower viscosity fluids have lower drag and friction but also typically exhibit less effective wear protection, compared to more viscous fluids. Thus, simply reducing the viscosity of a conventional transmission fluid does not solve the problems faced when trying to formulate a fluid for an at least partially electric transmission as the typical additive combinations found in such fluids give the fluids a volume resistivity which is too low for such applications. It is thus plain that the formulation of a transmission fluid which meets all of the varied and competing demands of an at least partially electric transmission is not a straightforward task.

The present disclosure is based on the discovery of a transmission fluid which has high volume resistivity, and so is effective to electrically insulate the electromechanical components of an at least partially electric transmission, and which also provides good wear protection to the mechanical components of the transmission, despite having a low viscosity. The competing demands of good electrical insulation, good wear protection, and even relatively low viscosity can thus all be met (optionally in addition to good energy efficiency as well).

SUMMARY

Accordingly, the present disclosure provides a transmission fluid composition comprising a major amount of a lubricating oil basestock, and a minor amount of an additive package comprising:

(i) a mixture comprising two or more compounds of structures (I):

(I)

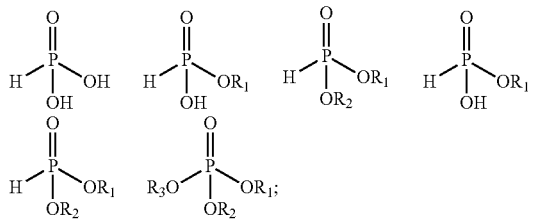

(ii) one or more compounds of structures (II):

(II)

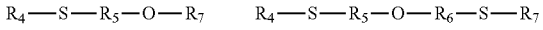

(iii) a detergent comprising a calcium salicylate; and (iv) a basic nitrogen-containing ashless dispersant comprising one or more compounds of structure (III):

(III)

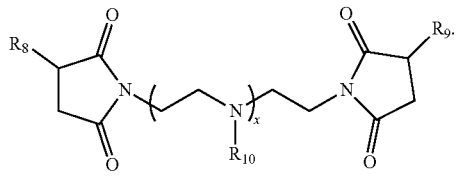

In structures (I), groups $R_1$, $R_2$, and $R_3$ (as applicable) may each independently be alkyl groups having 1 to 18 carbon atoms or alkyl groups having 1 to 18 carbon atoms where the alkyl chain is interrupted by a thioether linkage. In particular, in the mixture (i), at least some of groups $R_1$, $R_2$, and $R_3$ (as applicable) are alkyl groups having 1 to 18 carbon atoms where the alkyl chain is interrupted by a thioether linkage. In structures (II), groups $R_4$ and $R_2$ may each independently comprise or be alkyl groups having 1 to 12 carbon atoms, and groups $R_5$ and $R_6$, if present, may each independently comprise or be alkyl linkages having 2 to 12 carbon atoms. In structures (III), groups $R_8$ and $R_9$ may each independently be a hydrocarbon group made by the metallocene-catalyzed polymerization of an α-olefin feedstock comprising 1-butene, 1-pentene, 1-hexene, 1-heptene, 1-octene, 1-nonene, 1-decene, 1-undecene, 1-dodecene, 1-tetradecene, 1-octadecene, or mixtures thereof. Also in structures (III), each $R_{10}$ may independently be hydrogen, an acetyl moiety, or a moiety formed by reaction between ethylene carbonate and >N—$R_{10}$, and x may be from 1 to 10, being the same for all molecules of structure (III) or being an average of all molecules of structure (III) in a mixture of molecules of structure (III).

The present disclosure also provides uses of such transmission fluid compositions to control and/or reduce, and methods of controlling and/or reducing, wear in a hybrid electric- or fully electric-powered transmission lubricated by contacting one or more electrical or electronic components of the drivetrain with such transmission fluid compositions and simultaneously to cool/cooling at least a portion of electrical or electronic components of a hybrid electric- or fully electric-powered drivetrain contacted by such compositions.

DETAILED DESCRIPTION

It has been found that the specific combination of components (i), (ii), (iii), and (iv) can provide a combination of wear protection and volume resistivity, particularly in lower viscosity formulations, where each performance characteristic becomes harder to achieve individually and where one can typically only be obtained at the expense of the other. However, this combination of components can advantageously achieve adequate wear protection and volume resistivity in moderate to higher viscosity formulations as well.

It is known in the art that compounds containing phosphorus can provide wear protection to highly-loaded contacting metal surfaces. Without being bound by theory, this has been suggested to be the result of the formation of a phosphorus-containing 'glass' on a lubricated metal surface. In the present disclosure, only component (i) typically contains phosphorus. However, even though component (i) may be expected to provide suitable wear protection, the mere presence of phosphorus may not be enough or may be somewhat or largely counteracted by the presence of another component or mixture of components.

Additionally, volume resistivity is known to be reduced, relatively proportionately, with reductions in basestock viscosity. Furthermore, it has been suggested that polar and ionic compounds, dissolved or suspended within a basestock or diluent of a given viscosity, naturally reduce volume resistivity. Ironically, the functional components for lubricating fluids used in tandem with transmissions and/or other engine/drivetrain components are typically either ionic or polar, which generally sets up a trade-off situation. However, for applications in which lubricant fluids for mechanical components of an engine (e.g., drivetrain components, such as a transmission) are co-purposed as coolants for electrical and/or electronic components of an engine (such as a hybrid and/or fully electric engine), the requirements of the lubricant fluids are typically only such that they provide sufficient resistance to short circuits, when the fluid is in contact with the electrical and/or electronic engine components. In certain cases, this compromise can allow a small window for sufficient anti-wear properties for the mechanical parts and sufficient resistivity properties for the electrical/electronic parts. One aim of the present disclosure is to increase (or hopefully maximize) that window and thus the balance between resistivity and anti-wear properties.

It has surprisingly been found that either the combination of components (i), (ii), (iii), and (iv), or the combination of components (iv) and (v)(optionally with or without component (iii), but without both of components (i) and (ii)) can provide a particularly enhanced combination of wear protection (as reflected average lifetime from the needle-bearing fatigue test) and volume resistivity ("VR"; at elevated temperatures). The experiments reported herein below show that the respective combinations of components do not inherently provide both wear and VR benefits simultaneously, but can be selected to provide advantageous benefits with respect to a variety of comparative compositions with similar and/or slightly altered component profiles.

Component (i) may advantageously comprise a mixture of two or more compounds of the structures (I):

(I)

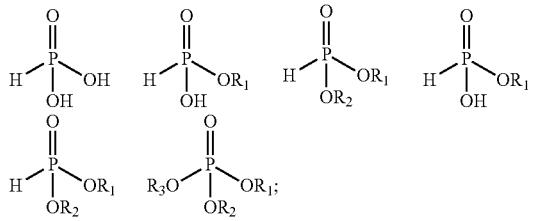

where groups $R_1$, $R_2$, and $R_3$ may each independently comprise or be alkyl groups having 1 to 18 carbon atoms and/or alkyl groups having 1 to 18 carbon atoms where the alkyl chain is interrupted by a thioether linkage, with the proviso that at least some of groups $R_1$, $R_2$, and $R_3$ may comprise or be alkyl groups having 1 to 18 carbon atoms where the alkyl chain is interrupted by a thioether linkage. The mixture may comprise three or more, four or more, or five or more compounds of the structures (1).

In some embodiments, groups $R_1$, $R_2$, and $R_3$ may each independently comprise or be alkyl groups having 4 to 10 carbon atoms and/or alkyl groups having 4 to 10 carbon atoms where the alkyl chain is interrupted by a thioether linkage, with the proviso that at least some of groups $R_1$, $R_2$, and $R_3$ may comprise or be alkyl groups having 4 to 10 carbon atoms where the alkyl chain is interrupted by a thioether linkage.

When groups $R_1$, $R_2$, and $R_3$ comprise alkyl groups (in which the alkyl chain is not interrupted by a thioether linkage), examples may include but are not limited to methyl, ethyl, propyl, and butyl, in particular including or being butyl.

When groups $R_1$, $R_2$, and $R_3$ comprise alkyl groups where the alkyl chain is interrupted by a thioether linkage, examples include groups of the structure —R'—S—R" where R' may be —$(CH_2)_n$—, in which n may be an integer from 2 to 4, and where R" may be —$(CH_2)_m$—$CH_3$, in which m may be an integer from 1 to 15, such as from 1 to 7.

In particular, in the mixture of compounds of structure (I) comprising component (i), at least 10% (e.g., at least 20%, at least 30%, or at least 40%) by mass of the mixture comprises compounds of structure (I) in which at least one of $R_1$, $R_2$, and $R_3$ comprises or is an alkyl group where the alkyl chain is interrupted by a thioether linkage, particularly having the structure —R'—S—R", where R' may be —$(CH_2)_n$—, in which n may be an integer from 2 to 4, and where R" may be —$(CH_2)_m$—$CH_3$, in which m may be an integer from 1 to 15, such as from 1 to 7.

Component (ii) may advantageously comprise one or more compounds of structures (II):

$$R_4—S—R_5—O—R_7 \qquad R_4—S—R_5—O—R_6—S—R_7 \tag{II}$$

where groups $R_4$ and $R_7$ may each independently comprise or be alkyl groups having 1 to 12 carbon atoms, and where $R_5$ and $R_6$ may each independently comprise or be alkyl linkages having 2 to 12 carbon atoms. In particular, $R_4$ and $R_3$ may each independently comprise or be $—(CH_2)_m—CH_3$, where m is an integer from 1 to 15, such as from 1 to 7, and $R_5$ and $R_6$ (if present) may each independently comprise or be $—(CH_2)_n—$, where n is an integer from 2 to 4. The mixture may comprise two or more or three or more compounds of the structures (II).

In particular, compounds of structure (I) (Component (i)) and compounds of structure (II) (Component (ii)) may each be present in the transmission fluid composition in an amount from 0.04 to 1.0% by mass, based on the total mass of the composition, e.g., from 0.05 to 0.8% by mass, from 0.05 to 0.5% by mass, or from 0.07 to 0.4% by mass. Additionally or alternatively, in particular, compounds of structure (I) (Component (i)) and compounds of structure (II)(Component (ii)) may collectively provide the transmission fluid composition with from 80 to 800 parts per million by mass of phosphorous, based on the total mass of the composition, e.g., from 100 to 700 ppm, from 150 to 600 ppm, or from 200 to 500 ppm. Phosphorus content can be measured in accordance with ASTM D5185. Further additionally or alternatively, in particular, a mass ratio of compounds of structure (I) (Component (i)) and compounds of structure (II) (Component (ii)) may be from 2:1 to 1:2, from 5:3 to 3:5, from 3:2 to 2:3, or from 4:3 to 3:4.

Component (iii) may advantageously comprise, consist essentially of, or be a calcium salicylate detergent. Calcium salicylate detergents are known in the art and may include neutral and/or overbased calcium salts of salicylic acids, such as alkylsalicylic acids.

Neutral calcium salicylate detergents, and neutral detergents generally, are those that contain stoichiometrically equivalent amounts of calcium in relation to the amount of (Lewis) acidic moieties present in the detergent. Thus, in general, neutral detergents can typically have a relatively low basicity, when compared to their overbased counterparts.

The term "overbased," for example in connection with calcium detergents, is used to designate the fact that the calcium component is present in stoichiometrically larger amounts than the corresponding (Lewis) acid component. The commonly employed methods for preparing the overbased salts involve heating a mineral oil solution of an acid with a stoichiometric excess of a neutralizing agent at an appropriate temperature (in this case, a calcium neutralizing agent, such as an oxide, hydroxide, carbonate, bicarbonate, sulfide, or combination thereof, at a temperature of about 50° C.) and filtering the resultant product. The use of a "promoter" in the neutralization step to aid the incorporation of a large excess of salt/base (in this case, calcium) likewise is known. Examples of compounds useful as a promoter may include, but are not necessarily limited to, phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve™ alcohol, Carbitol™ alcohol, ethylene glycol, stearyl alcohol, and cyclohexyl alcohol; amines such as aniline, phenylene diamine, phenothiazine, phenyl-beta-naphthylamine, and dodecylamine; and combinations thereof. A particularly effective method for preparing the basic salts comprises mixing an acidic substance with an excess of calcium neutralizing agent and at least one alcohol promoter, and carbonating the mixture at an elevated temperature, such as from 60 to 200° C.

In particular, the calcium salicylate detergent of component (iii) may be present in the transmission fluid composition in an amount from 0.03 to 2.0% by mass, based on the total mass of the composition, e.g., from 0.05 to 0.7% by mass, from 0.07 to 1.0% by mass, or from 0.10 to 1.9% by mass. Additionally or alternatively, the calcium salicylate detergent of component (iii) may be present in the transmission fluid composition in an amount sufficient to provide the transmission fluid composition with from 30 to 2000 parts per million by mass (ppm) of calcium, based on the mass of the composition, e.g., from 45 to 450 ppm, from 50 to 800 ppm, or from 100 to 1800 ppm. Calcium content can be measured in accordance with ASTM D5185.

Component (iv) may comprise, consist essentially of, or be one or more basic nitrogen-containing having structure III as follows:

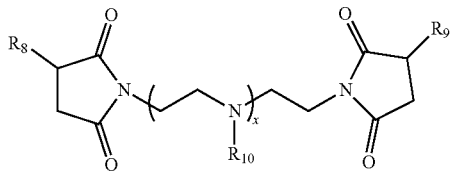

wherein: $R_8$ and $R_9$ are each independently a hydrocarbon group made by the metallocene-catalyzed polymerization of an α-olefin feedstock comprising 1-butene, 1-pentene, 1-hexene, 1-heptene, I-octene, 1-nonene, 1-decene, 1-undecene, 1-dodecene, 1-tetradecene, 1-octadecene, or mixtures thereof, such that the dispersant arms or endcaps of $R_8$ and $R_9$ are each metallocene-catalyzed poly(alpha-olefins), or mPAOs; each $R_{10}$ is independently hydrogen, an acetyl moiety, or a moiety formed by reaction between ethylene carbonate and $>N—R_{10}$; and x is from 1 to 10 and is the same for all molecules of structure (III) or is an average of all molecules of structure (III) in a mixture of molecules of structure (III).

In particular embodiments of structure (III) of component (iv), the α-olefin feedstock comprises or consists essentially of 1-octene, 1-decene, 1-dodecene, or mixtures thereof. Additionally or alternatively, in particular embodiments of structure (III) of component (iv), each $R_{10}$ is independently hydrogen or an acetyl moiety. Further additionally or alternatively, in particular embodiments of structure (III) of component (iv), x is from 3 to 10.

In particular embodiments, the mPAO endcaps or arms ($R_1$ and $R_2$ moieties) of the ashless dispersant of component (iv) may each independently exhibit a number average molecular weight (Mn) from 300 to 20000 Daltons, as determined by GPC with reference to linear polystyrene standards, e.g., from 400 to 15000 Daltons, from 450 to 10000 Daltons, from 500 to 8000 Daltons, from 650 to 6500 Daltons, from 800 to 5000 Daltons, or from 900 to 3000 Daltons; in particular from 300 to 20000 Daltons, from 500 to 8000 Daltons, or from 800 to 5000 Daltons.

Examples of such additional ashless dispersants may include mPAO-based succinimides, mPAO-based succinamides, mixed ester/amides of mPAO-substituted succinic acid (mPAOSA), and hydroxyesters of mPAO-substituted succinic acid, as well as reaction products and mixtures thereof.

Such basic nitrogen-containing ashless dispersants may be used as lubricating oil additives, and methods for their preparation are described in the patent literature. Exemplary ashless dispersants of structure (III) may include mPAO-based succinimides and succinamides in which the mPAO-substituent arms each contain greater than 36 carbons, e.g., greater than 40 carbon atoms. These materials can be readily made by reacting an mPAO functionalized with a dicarboxylic acid or an mPAO functionalized with an anhydride (such as reacted maleic acid) with a molecule containing amine functionality. Examples of suitable amines may include polyamines such as polyalkylene polyamines, hydroxy-substituted polyamines, polyoxyalkylene polyamines, and combinations thereof. The amine functionality may be provided by polyalkylene polyamines such as tetraethylene pentamine and pentaethylene hexamine. Mixtures where the average number of nitrogen atoms per polyamine molecule is greater than 7 are also available. These are commonly called heavy polyamines or H-PAMs and may be commercially available under trade names such as HPA™ and HPA-X™ from DowChemical, E-100™ from Huntsman Chemical, et al. Examples of hydroxy-substituted polyamines may include N-hydroxyalkyl-alkylene polyamines such as N-(2-hydroxyethyl)ethylene diamine, N-(2-hydoxyethyl)piperazine, and/or N-hydroxyalkylated alkylene diamines of the type described, for example, in U.S. Pat. No. 4,873,009. Examples of polyoxyalkylene polyamines may include polyoxyethylene and/or polyoxypropylene diamines and triamines (as well as co-oligomers thereof) having an average Mn from about 200 to about 5000 Daltons. Products of this type may be commercially available under the tradename Jeffamine™.

As is known in the art, reaction of the amine with the mPAO-functionalized dicarboxylic acid and/or anhydride (suitably, a reaction product of a reactive site on the mPAO molecule and an alkenyl succinic anhydride or maleic anhydride) can be conveniently achieved by heating the reactants together, e.g., in an oil solution. Reaction temperatures of ~100° C. to ~250° C. and reaction times from ~1 to ~10 hours may be typical. Reaction ratios can vary considerably, but generally a coupling ratio of approximately 1 (moles of anhydride functional group/dicarboxylic acid per moles of primary amine functional group) can be desirable between the reactants.

In particular, the nitrogen-containing ashless dispersant of component (iv) may include a mPAO-based succinimide formed from succinic anhydride-functionalized mPAO and a polyalkylene polyamine such as tetraethylene pentamine or H-PAM. The mPAO endcaps or arms may each be derived from metallocene-catalyzed polymerization (oligomerization) of an alpha-olefin feedstock, as described herein, and may each exhibit a number average molecular weight (Mn) from 500 to 5000 Daltons, e.g., from 750 to 2500 Daltons. These dispersants, similarly to other dispersants known in the art, may be further treated (e.g., with a secondary nitrogen-capping agent such as acetic anhydride and/or ethylene carbonate, with a borating/boronating agent, and/or with an inorganic acid of phosphorus). Suitable examples of post-treated dispersants may generally be found, e.g., in U.S. Pat. Nos. 3,254,025, 3,502,677, and 4,857,214.

Although borating of dispersants is known and may be desirable, in particular embodiments the dispersant(s) of component (iv) individually (collectively), and indeed all components of the additive packages and/or transmission fluids according to the present disclosure (altogether), may comprise less than 200 parts per million by mass (ppm) of boron, based on the total mass of the composition, e.g., less than 150 ppm boron, less than 100 ppm boron, less than 70 ppm boron, or less than 50 ppm boron.

In particular, the nitrogen-containing ashless dispersant of component (iv) may be present in the transmission fluid composition in an amount from 0.50 to 8.0% by mass, based on the mass of the transmission fluid composition, e.g., from 0.75 to 5.0% by mass, from 0.90 to 3.5% by mass, or from 1.0 to 3.0% by mass.

The amount of lubricating oil basestock in transmission fluid compositions according to the present disclosure can typically be a major amount (i.e., more than 50%, based on the weight of the composition), with the additive package collectively, and each of the components of the additive package individually, typically constituting a minor amount (i.e., less than 50%, based on the weight of the composition). For example, the transmission fluid composition may comprise from above 50% to 99.5%, from above 50% to 99%, from above 50% to 98.5%, from above 50% to 98%, from above 50% to 97.5%, from above 50% to 97%, from above 50% to 96.5%, from above 50% to 96%, from above 50% to 95.5%, from above 50% to 95%, from 60% to 99.5%, from 60% to 99%, from 60% to 98.5%, from 60% to 98%, from 60% to 97.5%, from 60% to 97%, from 60% to 96.5%, from 60% to 96%, from 60% to 95.5%, from 60% to 95%, from 70% to 99.5%, from 70% to 99%, from 70% to 98.5%, from 70% to 98%, from 70% to 97.5%, from 70% to 97%, from 70% to 96.5%, from 70% to 96%, from 70% to 95.5%, from 70% to 95%, from 75% to 99.5%, from 75% to 99%, from 75% to 98.5%, from 75% to 98%, from 75% to 97.5%, from 75% to 97%, from 75% to 96.5%, from 75% to 96%, from 75% to 95.5%, from 75% to 95%, from 80% to 99.5%, from 80% to 99%, from 80% to 98.5%, from 80% to 98%, from 80% to 97.5%, from 80% to 97%, from 80% to 96.5%, from 80% to 96%, from 80% to 95.5%, or from 80% to 95%, of lubricating oil basestock, based on the weight of the composition, in particular from 60% to 99%, from 70 to 98%, from 75 to 97%, or from 80 to 96.5%, based on the weight of the composition. Additionally or alternatively, the transmission fluid composition may comprise from 0.5% to below 50%, from 0.5% to 39%, from 0.5% to 34%, from 0.5% to 29%, from 0.5% to 24%, from 0.5% to 19.5%, from 0.5% to 14.5%, from 0.5% to 11.5%, from 0.5% to 9.5%, from 0.5% to 7.5%, from 0.5% to 6.5%, from 0.5% to 5.5%, from 0.5% to 5.0%, from 0.5% to 4.5%, from 0.5% to 4.0%, from 0.5% to 3.5%, from 0.5% to 3.0%, from 0.5% to 2.5%, from 0.5% to 2.0%, from 0.5% to 1.5%, from 1.9% to below 50%, from 1.9% to 39%, from 1.9% to 34%, from 1.9% to 29%, from 1.9% to 24%, from 1.9% to 19.5%, from 1.9% to 14.5%, from 1.9% to 11.5%, from 1.9% to 9.5%, from 1.9% to 7.5%, from 1.9% to 6.5%, from 1.9% to 5.5%, from 1.9% to 5.0%, from 1.9% to 4.5%, from 1.9% to 4.0%, from 1.9% to 3.5%, from 1.9% to 3.0%, from 2.9% to below 50%, from 2.9% to 39%, from 2.9% to 34%, from 2.9% to 29%, from 2.9% to 24%, from 2.9% to 19.5%, from 2.9% to 14.5%, from 2.9% to 11.5%, from 2.9% to 9.5%, from 2.9% to 7.5%, from 2.9% to 6.5%, from 2.9% to 5.5%, from 2.9% to 5.0%, from 2.9% to 4.5%, from 2.9% to 4.0%, from 3.9% to below 50%, from 3.9% to 39%, from 3.9% to 34%, from 3.9% to 29%, from 3.9% to 24%, from 3.9% to 19.5%, from 3.9% to 14.5%, from 3.9% to 11.5%, from 3.9% to 9.5%, from 3.9% to 7.5%, from 3.9% to 6.5%, from 3.9% to 5.5%, from 3.9% to 5.0%, from 4.8% to below 50%, from 4.8% to 39%, from 4.8% to 34%, from 4.8% to 29%, from 4.8% to 24%, from 4.8% to 19.5%, from 4.8% to 14.5%, from 4.8% to 11.5%, from 4.8% to 9.5%, from 4.8% to 7.5%, from 4.8% to 6.5%, from 4.8% to 5.5%, from 5.8% to below 50%, from 5.8% to 39%, from 5.8% to 34%, from 5.8% to 29%, from 5.8% to 24%, from 5.8% to 19.5%, from 5.8% to 14.5%, from 5.8% to 11.5%, from 5.8% to 9.5%, from 5.8% to 7.5%, from 5.8% to 6.5%, from 6.7% to below 50%, from 6.7% to 39%, from 6.7% to 34%, from 6.7% to 29%, from 6.7% to 24%, from 6.7% to 19.5%, from 6.7% 14.5%, from 6.7% to 11.5%, from 6.7% to 9.5%, from 6.7% to 7.5%, from 7.6% to below 50%, from 7.6% to 39%, from 7.6% to 34%, from 7.6% to 29%, from 7.6% to 24%, from 7.6% to 19.5%, from 7.6% to 14.5%, from 7.6% to 11.5%, from 7.6% to 9.5%, from 8.5% to below 50%, from 8.5% to 39%, from 8.5% to 34%, from 8.5% to 29%, from 8.5% to 24%, from 8.5% to 19.5%, from 8.5% to 14.5%, from 8.5% to 11.5%, or from 8.5% to 9.5%, of additive package components, based on the weight of the composition, in particular from 1.9% to 29%, from 3.9% to 24%, from 4.8% to 14.5%, or from 5.8 to 11.5%, based on the weight of the composition.

The lubricating oil basestock may be any suitable lubricating oil basestock known in the art. Both natural and synthetic lubricating oil basestocks may be suitable. Natural lubricating oils may include animal oils, vegetable oils (e.g., castor oil and lard oil), petroleum oils, mineral oils, oils derived from coal or shale, and combinations thereof. One particular natural lubricating oil includes or is mineral oil.

Suitable mineral oils may include all common mineral oil basestocks, including oils that are naphthenic or paraffinic in chemical structure. Suitable oils may be refined by conventional methodology using acid, alkali, and clay, or other agents such as aluminum chloride, or they may be extracted oils produced, for example, by solvent extraction with solvents such as phenol, sulfur dioxide, furfural, dichlorodiethyl ether, etc., or combinations thereof. They may be hydrotreated or hydrofined, dewaxed by chilling or catalytic dewaxing processes, hydrocracked, or some combination thereof. Suitable mineral oils may be produced from natural crude sources or may be composed of isomerized wax materials, or residues of other refining processes.

Synthetic lubricating oil basestocks may include hydrocarbon oils and halo-substituted hydrocarbon oils such as oligomerized, polymerized, and interpolymerized olefins (e.g., polybutylenes, polypropylenes, propylene, isobutylene copolymers, chlorinated polylactenes, poly(1-hexenes), poly (1-octenes), poly-(1-decenes), etc., and mixtures thereof); alkylbenzenes (e.g., dodecyl-benzenes, tetradecylbenzenes, dinonyl-benzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof, and the like; and combinations and/or reaction products thereof.

In some embodiments, oils from this class of synthetic oil basestocks may comprise or be polyalphaolefins (PAO), including hydrogenated oligomers of an alpha-olefin, particularly oligomers of 1-decene, such as those produced by free radical processes, Ziegler catalysis, or cationic catalysis. They may, for example, be oligomers of branched or straight chain alpha-olefins having from 2 to 16 carbon atoms, specific non-limiting examples including polypropenes, polyisobutenes, poly-1-butenes, poly-1-hexenes, poly-1-octenes, poly-1-decene, poly-1-dodecene, and mixtures and/or interpolymerscopolymers thereof.

Synthetic lubricating oil basestocks may additionally or alternatively include alkylene oxide polymers, interpolymers, copolymers, and derivatives thereof, in which any (most) terminal hydroxyl groups have been modified by esterification, etherification, etc. This class of synthetic oils may be exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average Mn of ~1000 Daltons, diphenyl ether of polypropylene glycol having an average Mn from about 1000 to about 1500 Daltons); and mono- and poly-carboxylic esters thereof (e.g., acetic acid ester(s), mixed $C_3$-$C_8$ fatty acid esters, $C_{12}$ oxo acid diester(s) of tetraethylene glycol, or the like, or combinations thereof).

Another suitable class of synthetic lubricating oil basestocks may comprise the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, a complex ester formed by reacting one mole of sebacic acid with two moles of tetraethylene glycol and two moles of 2-ethyl-hexanoic acid, and the like, and combinations thereof. A preferred type of oil from this class of synthetic oils may include adipates of $C_4$ to $C_{12}$ alcohols.

Esters useful as synthetic lubricating oil basestocks may additionally or alternatively include those made from $C_5$-$C_{12}$ monocarboxylic acids, polyols, and/or polyol ethers, e.g., such as neopentyl glycol, trimethylolpropane pentaerythritol, dipentaerythritol, tripentaerythritol, and the like, as well as combinations thereof.

The lubricating oil basestocks may be derived from unrefined oils, refined oils, re-refined oils, or mixtures thereof. Unrefined oils are obtained directly from a natural source or synthetic source (e.g., coal, shale, or tar sands bitumen) without further purification or treatment. Examples of unrefined oils may include a shale oil obtained directly from a retorting operation, a petroleum oil obtained directly from distillation, or an ester oil obtained directly from an esterification process, each or a combination of which may then be used without further treatment. Refined oils are similar to the unrefined oils, except that refined oils have typically been treated in one or more purification steps to change chemical structure and/or to improve one or more properties. Suitable purification techniques may include distillation, hydrotreating, dewaxing, solvent extraction, acid or base extraction, filtration, and percolation, all of which are known to those skilled in the art. Re-refined oils may be obtained by treating used and/or refined oils in processes similar to those used to obtain refined oils in the first place. Such re-refined oils may be known as reclaimed or reprocessed oils and may often additionally be processed by techniques for removal of spent additives and oil breakdown products.

Another additional or alternative class of suitable lubricating oil basestocks may include those basestocks produced from oligomerization of natural gas feed stocks or isomerization of waxes. These basestocks can be referred to in any number of ways but commonly they are known as Gas-to-Liquid (GTL) or Fischer-Tropsch basestocks.

The lubricating oil basestock according to the present disclosure may be a blend of one or more of the oils/basestocks described herein, whether of a similar or different type, and a blend of natural and synthetic lubricating oils (i.e., partially synthetic) is expressly contemplated for this disclosure.

Lubricating oils can be classified as set out in the American Petroleum Institute (API) publication "Engine Oil Licensing and Certification System", Industry Services Department, Fourteenth Edition, December 1996, Addendum 1, December 1998, in which oils are categorized as follows:

a) Group I basestocks contain less than 90 percent saturates and/or greater than 0.03 percent sulfur and have a viscosity index greater than or equal to 80 and less than 120;
b) Group II basestocks contain greater than or equal to 90 percent saturates and less than or equal to 0.03 percent sulfur and have a viscosity index greater than or equal to 80 and less than 120;
c) Group III basestocks contain greater than or equal to 90 percent saturates and less than or equal to 0.03 percent sulfur and have a viscosity index greater than or equal to 120;
d) Group IV basestocks are polyalphaolefins (PAO); and,
e) Group V basestocks include all other basestock oils not included in Groups I, II, III, or IV.

In an embodiment of the present disclosure, the lubricating oil basestock may comprise or be a mineral oil or a mixture of mineral oils, in particular mineral oils of Group II and/or Group III (of the API classification). Additionally or alternatively, the lubricating oil basestock may comprise or be a synthetic oil such as a polyalphaolefin (Group IV) and/or an oil of Group V. In embodiments where desired formulation viscosities are very low (e.g., less than 4.0 cSt or less than 3.5 cSt), it may be advantageous for the lubricating oil basestock to be a Group IV (polyalphaolefin) basestock or mixture of Group IV basestocks, or to be comprised of at least 40% (e.g., at least 50%, at least 60%, at least 70%, at least 80%, or at least 90%) by weight of one or more Group IV basestocks.

Advantageously, the lubricating oil basestock(s), individually or collectively, may exhibit a kinematic viscosity at 100° C. (KV100), as measured by ASTM D445, of from 1.0 cSt to 10 cSt (e.g., from 1.0 cSt to 8.1 cSt, from 1.0 cSt to 7.2 cSt, from 1.0 cSt to 6.5 cSt, from 1.0 cSt to 6.0 cSt, from 1.0 cSt to 5.5 cSt, from 1.0 cSt to 5.0 cSt, from 1.0 cSt to 4.5 cSt, from 1.0 cSt to 4.0 cSt, from 1.0 cSt to 3.5 cSt, from 1.5 cSt to 3.3 cSt, from 1.0 cSt to 3.0 cSt, from 1.0 cSt to 2.5 cSt, from 1.0 cSt to 2.0 cSt, from 1.5 cSt to 10 cSt, from 1.5 cSt to 8.1 cSt, from 1.5 cSt to 7.2 cSt, from 1.5 cSt to 6.5 cSt, from 1.5 cSt to 6.0 cSt, from 1.5 cSt to 5.5 cSt, from 1.5 cSt to 5.0 cSt, from 1.5 cSt to 4.5 cSt, from 1.5 cSt to 4.0 cSt, from 1.5 cSt to 3.5 cSt, from 1.5 cSt to 3.3 cSt, from 1.5 cSt to 3.0 cSt, from 1.5 cSt to 2.5 cSt, from 2.0 cSt to 10 cSt, from 2.0 cSt to 8.1 cSt, from 2.0 cSt to 7.2 cSt, from 2.0 cSt to 6.5 cSt, from 2.0 cSt to 6.0 cSt, from 2.0 cSt to 5.5 cSt, from 2.0 cSt to 5.0 cSt, from 2.0 cSt to 4.5 cSt, from 2.0 cSt to 4.0 cSt, from 2.0 cSt to 3.5 cSt, from 2.0 cSt to 3.0 cSt, from 2.0 cSt to 2.5 cSt, from 2.5 cSt to 10 cSt, from 2.5 cSt to 8.1 cSt, from 2.5 cSt to 7.2 cSt, from 2.5 cSt to 6.5 cSt, from 2.5 cSt to 6.0 cSt, from 2.5 cSt to 5.5 cSt, from 2.5 cSt to 5.0 cSt, from 2.5 cSt to 4.5 cSt, from 2.5 cSt to 4.0 cSt, from 2.5 cSt to 3.5 cSt, from 2.5 cSt to 3.0 cSt, from 2.7 cSt to 10 cSt, from 2.7 cSt to 8.1 cSt, from 2.7 cSt to 7.2 cSt, from 2.7 cSt to 6.5 cSt, from 2.7 cSt to 6.0 cSt, from 2.7 cSt to 5.5 cSt, from 2.7 cSt to 5.0 cSt, from 2.7 cSt to 4.5 cSt, from 2.7 cSt to 4.0 cSt, from 2.7 cSt to 3.5 cSt, from 2.7 cSt to 3.0 cSt, from 3.0 cSt to 10 cSt, from 3.0 cSt to 8.1 cSt, from 3.0 cSt to 7.2 cSt, from 3.0 cSt to 6.5 cSt, from 3.0 cSt to 6.0 cSt, from 3.0 cSt to 5.5 cSt, from 3.0 cSt to 5.0 cSt, from 3.0 cSt to 4.5 cSt, from 3.0 cSt to 4.0 cSt, from 3.0 cSt to 3.5 cSt, from 3.5 cSt to 10 cSt, from 3.5 cSt to 8.1 cSt, from 3.5 cSt to 7.2 cSt, from 3.5 cSt to 6.5 cSt, from 3.5 cSt to 6.0 cSt, from 3.5 cSt to 5.5 cSt, from 3.5 cSt to 5.0 cSt, from 3.5 cSt to 4.5 cSt, from 3.5 cSt to 4.0 cSt, from 4.0 cSt to 10 cSt, from 4.0 cSt to 8.1 cSt, from 4.0 cSt to 7.2 cSt, from 4.0 cSt to 6.5 cSt, from 4.0 cSt to 6.0 cSt, from 4.0 cSt to 5.5 cSt, from 4 cSt to 5.0 cSt, or from 4.0 cSt to 4.5 cSt), in particular from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt.

The required components (i), (ii), (iii), and (iv) may be added separately to the lubricating oil basestock to form the transmission fluid composition or, more conveniently, may be added to the oil as an additive package containing the required compounds dissolved or dispersed in a carrier fluid. Further alternatively, two or more of the components may be added together as an additive package, while one or more other components may be added separately to the lubricating oil basestock and/or to the admixture for forming the transmission fluid composition. Such an additive package may optionally further contain, or the transmission fluid composition may contain separate from the additive package, one or more co-additives as defined hereinbelow.

Co-Additives

Co-additives commonly found in transmission fluids may optionally be included in the transmission fluid composition of the present disclosure. Suitable co-additives will be known to those skilled in the art. Some examples are described herein.

Additional Ashless Dispersants

In some embodiments, the additive package and/or the transmission fluid composition may further comprise one or more additional basic nitrogen-containing ashless dispersants different from structure (III) of component (iv). Indeed, such additional nitrogen-containing ashless dispersant(s), when present, may advantageously be of structure (IV):

(IV)

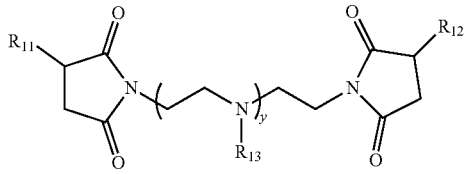

wherein: $R_{11}$ and $R_{12}$ are each independently a hydrocarbyl group (e.g., a polyisobutenyl moiety) having a number average molecular weight (Mn) from 500 to 5000 Daltons or from 750 to 2500 Daltons, as determined by GPC with reference to linear polystyrene standards; each $R_{13}$ is independently hydrogen, an acetyl moiety, or a moiety formed by reaction between ethylene carbonate and >N—$R_{13}$ (in particular, hydrogen or an acetyl moiety); and y is from 1 to 10 (in particular, from 3 to 10) and is the same for all molecules of structure (IV) or is an average of all molecules of structure (IV) in a mixture of molecules of structure (IV).

Examples of such additional ashless dispersants may include polyisobutenyl succinimides, polyisobutenyl succinamides, mixed ester/amides of polyisobutenyl-substituted succinic acid, hydroxyesters of polyisobutenyl-substituted succinic acid, and Mannich condensation products of hydrocarbyl-substituted phenols, formaldehyde, and polyamines, as well as reaction products and mixtures thereof.

Such basic nitrogen-containing ashless dispersants are well-known lubricating oil additives and methods for their preparation are extensively described in the patent literature. Exemplary additional dispersants may include the polyisobutenyl succinimides and succinamides in which the polyisobutenyl-substituent is a long-chain of greater than 36 carbons, e.g., greater than 40 carbon atoms. These materials can be readily made by reacting a polyisobutenyl-substituted dicarboxylic acid material with a molecule containing amine functionality. Examples of suitable amines may include polyamines such as polyalkylene polyamines, hydroxy-substituted polyamines, polyoxyalkylene polyamines, and combinations thereof. The amine functionality may be provided by polyalkylene polyamines such as tetraethylene pentamine and pentaethylene hexamine. Mixtures where the average number of nitrogen atoms per polyamine molecule is greater than 7 are also available. These are commonly called heavy polyamines or H-PAMs and may be commercially available under trade names such as HPA™ and HPA-X™ from DowChemical, E-100™ from Huntsman Chemical, et al. Examples of hydroxy-substituted polyamines may include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines may include polyoxyethylene and polyoxypropylene diamines and triamines having an average Mn from about 200 to about 2500 Daltons. Products of this type may be commercially available under the tradename Jeffamine™.

As is known in the art, reaction of the amine with the polyisobutenyl-substituted dicarboxylic acid material (suitably an alkenyl succinic anhydride or maleic anhydride) can be conveniently achieved by heating the reactants together, e.g., in an oil solution. Reaction temperatures of ~100° C. to ~250° C. and reaction times from ~1 to ~10 hours may be typical. Reaction ratios can vary considerably, but generally from about 0.1 to about 1.0 equivalents of dicarboxylic acid unit content may be used per reactive equivalent of the amine-containing reactant.

In particular, the additional ashless dispersant, when present, may include a polyisobutenyl succinimide formed from polyisobutenyl succinic anhydride and a polyalkylene polyamine such as tetraethylene pentamine or H-PAM. The polyisobutenyl group may be derived from polyisobutene and may exhibit a number average molecular weight (Mn) from about 500 to about 5000 Daltons, e.g., from about 750 to about 2500 Daltons. As is known in the art, these and other dispersants may be post treated (e.g., with a secondary nitrogen-capping agent such as acetic anhydride and/or ethylene carbonate, with a borating/boronating agent, and/or with an inorganic acid of phosphorus). Suitable examples may be found, for instance, in U.S. Pat. Nos. 3,254,025, 3,502,677, and 4,857,214.

When used, an additional ashless dispersant may be present in an amount of from 0.01 to 10% by mass, based on the mass of the transmission fluid composition, e.g., from 0.05 to 7% by mass or from 0.1 to 5% by mass.

Non-Calcium-Salicylate Detergents

In some embodiments, the additive package and/or the transmission fluid composition may further comprise a detergent other than a calcium salicylate. In other embodiments, the additive package and/or the transmission fluid composition may further comprise substantially no other detergents, aside from the calcium salicylate of component (iii). In alternative embodiments, the additive package and/or the transmission fluid composition may comprise substantially no intentionally added phenate detergent and/or substantially no intentionally added sulfonate detergent.

When the transmission fluid composition comprises an additional non-calcium-salicylate detergent, it may also be a calcium-containing detergent. These detergents are typically sufficiently oil-soluble or dispersible such as to remain dissolved or dispersed in an oil in order to be transported by the oil to their intended site of action. Additional calcium-containing detergents are known in the art and include neutral and overbased calcium salts with acidic substances such as sulfonic acids, carboxylic acids, alkyl phenols, sulfurized alkyl phenols, and mixtures of these substances.

Examples of non-calcium-salicylate detergents useful in the transmission fluid compositions of the present disclosure may include, but are not necessarily limited to, neutral and/or overbased salts of such substances as calcium phenates; sulfurized calcium phenates (e.g., wherein each aromatic group has one or more aliphatic groups to impart hydrocarbon solubility); calcium sulfonates (e.g., wherein each sulfonic acid moiety is attached to an aromatic nucleus, which in turn usually contains one or more aliphatic substituents to impart hydrocarbon solubility); calcium salts of hydrolyzed phosphosulfurized olefins (e.g., having 10 to 2000 carbon atoms) and/or of hydrolyzed phosphosulfurized alcohols and/or aliphatic-substituted phenolic compounds (e.g., having 10 to 2000 carbon atoms); calcium salts of aliphatic carboxylic acids and/or aliphatic substituted cycloaliphatic carboxylic acids; and combinations and/or reaction products thereof; as well as many other similar calcium salts of oil-soluble organic acids. Mixtures of neutral and/or overbased salts of two or more different non-salicylic acids can be used, if desired (e.g., one or more overbased calcium phenates with one or more overbased calcium sulfonates).

Methods for the production of oil-soluble neutral and overbased calcium detergents are well known to those skilled in the art and are extensively reported in the patent literature. Calcium-containing detergents may optionally be post-treated, e.g., borated. Methods for preparing borated detergents are well known to those skilled in the art, and are extensively reported in the patent literature.

In some embodiments, though not typically preferred, an additional detergent compound can include a magnesium-containing detergent, including a magnesium-containing salicylate, a magnesium-containing phenate, a magnesium-containing sulfonate, and/or any a magnesium-containing version of any other calcium-containing detergent described herein, as well as any mixtures thereof.

When present, an additional detergent may comprise, consist essentially of, or consist of a neutral or overbased calcium sulfonate detergent and/or a neutral or overbased calcium phenate detergent. When present, the combination of the calcium salicylate of component (iii) plus the additional detergent may collectively provide the transmission fluid composition with from 75 to 2500 parts per million by mass (ppm) of calcium, based on the mass of the composition, e.g., from 85 to 1800 ppm, from 100 to 1000 ppm, or from 120 to 500 ppm. Calcium content may be measured in accordance with ASTM D5185.

Antioxidants

Antioxidants are sometimes referred to as oxidation inhibitors and may increase the resistance (or decrease the susceptibility) of the transmission fluid composition to oxidation. They may work by combining with and modifying oxidative agents, such as peroxides and other free radical-forming compounds, to render them harmless, e.g., by decomposing them or by rendering inert a catalyst or facilitator of oxidation. Oxidative deterioration can be evidenced by sludge in the fluid with increased use, by varnish-like deposits on metal surfaces, and sometimes by viscosity increase.

Examples of suitable antioxidants may include, but are not limited to, copper-containing antioxidants, sulfur-containing antioxidants, aromatic amine-containing and/or amide-containing antioxidants, hindered phenolic antioxidants, dithiophosphates and derivatives, and the like, as well as combinations and certain reaction products thereof. Some anti-oxidants may be ashless (i.e., may contain few, if any, metal atoms other than trace or contaminants). In preferred embodiments, one or more antioxidants is present in a transmission fluid composition according to the present disclosure. In particular, a transmission fluid composition of the present disclosure may comprise a combination of an aminic antioxidant and a hindered phenolic antioxidant.

Corrosion Inhibitors

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

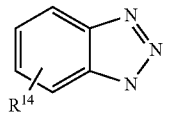

wherein $R^{14}$ is absent or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. A preferred corrosion inhibitor may comprise or be benzotriazole and/or tolyltriazole.

Additionally or alternatively, the corrosion inhibitor may include a substituted thiadiazoles represented by the structure:

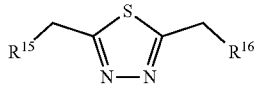

wherein $R^{15}$ and $R^{16}$ are independently hydrogen or a hydrocarbon group, which group may be aliphatic or aromatic, including cyclic, alicyclic, aralkyl, aryl and alkaryl. These substituted thiadiazoles are derived from the 2,5-dimercapto-1,3,4-thiadiazole (DMTD) molecule. Many derivatives of DMTD have been described in the art, and any such compounds can be included in the transmission fluid used in the present disclosure. For example, U.S. Pat. Nos. 2,719,125, 2,719,126, and 3,087,937 describe the preparation of various 2, 5-bis-(hydrocarbon dithio)-1,3,4-thiadiazoles.

Further additionally or alternatively, the corrosion inhibitor may include one or more other derivatives of DMTD, such as a carboxylic ester in which $R^{15}$ and $R^{16}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic monocarboxylic carboxylic acids having at least 10 carbon atoms are described, for example, in U.S. Pat. No. 2,836,564. This process produces DMTD derivatives wherein $R^{15}$ and $R^{16}$ are HOOC—CH($R^{17}$)—($R^{17}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A particular class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical.

In particular, a transmission fluid composition of the present disclosure may comprise a substituted thiadiazole, a substituted benzotriazole, or a combination thereof.

When desired, corrosion inhibitors can be used in any effective amount, but, when used, may typically be used in amounts from about 0.001 to 5.0 mass %, based on the mass of the transmission fluid, e.g., from 0.005 to 3.0 mass % or from 0.01 to 1.0 mass %.

Friction Modifiers

Friction modifiers may include derivatives of polyethylene polyamines and/or ethoxylated long chain amines. The derivatives of polyethylene polyamines may advantageously include succinimides of a defined structure or may be simple amides.

Suitable succinimides derived from polyethylene polyamines may include those of the following structure:

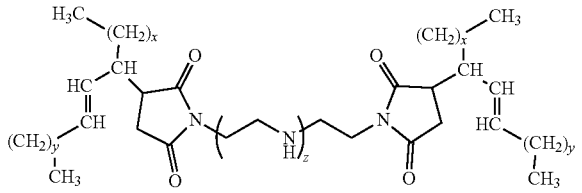

wherein x+y may be from 8 to 15 and z may be 0 or an integer from 1 to 5, in particular wherein x+y may be from 11 to 15 (e.g., 13) and z may be from 1 to 3. More broadly, such friction modifiers can be expressed using the following general structure:

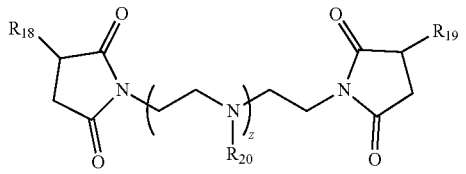

wherein each of $R_{18}$ and $R_{19}$ is independently:

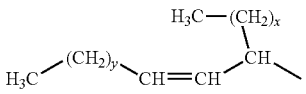

such that x+y is from 8 to 15 (in particular, from 11 to 15, e.g., 13) and z is 0 or an integer from 1 to 5 (in particular, an integer from 1 to 5 or an integer from 1 to 3); and wherein each $R_{20}$ is independently hydrogen, an acetyl moiety, or a moiety formed by reaction between ethylene carbonate and >N-Rao (in particular, hydrogen or an acetyl moiety).

Preparation of such friction modifiers is described, for example, in U.S. Pat. No. 5,840,663.

The above succinimides may be post-reacted with acetic anhydride to form friction modifiers in which each $R_{20}$ is independently an acetyl group, as exemplified by the following structure (in which z=1):

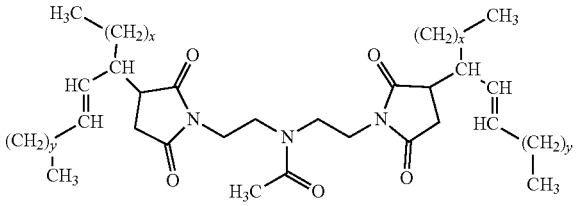

Preparation of this friction modifier, e.g., can be found in U.S. Patent Application Publication No. 2009/0005277. Post reaction with other reagents, e.g., borating agents, is also known in the art.

When present, such succinimide friction modifiers may be used in any effective amount. Typically, they may be used in amounts from 0.1 to 10.0 mass percent in the transmission fluid, e.g., from 0.5 to 6.0 mass percent or from 2.0 to 5.0 mass percent.

An example of an alternative simple amide may have the following structure:

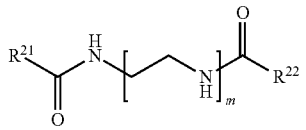

wherein $R^{21}$ and $R^{22}$ may be the same or different alkyl groups. For example, $R^{21}$ and $R^{22}$ may be $C_{14}$ to $C_{20}$ alkyl groups, which may be linear or branched, and m can be an integer from 1 to 5. In particular, $R^{21}$ and $R^{22}$ may both be derived from iso-stearic acid, and m may be 4.

When present, such simple amide friction modifiers may be used in any effective amount. Typically, they may be used in amounts from 0.1 to 5.0 mass percent in the transmission fluid, e.g., from 0.2 to 4.0 mass percent or from 0.25 to 3.0 mass percent.

Suitable ethoxylated amine friction modifiers may include or be reaction products of primary amines and/or diamines with ethylene oxide. The reaction with ethylene oxide may be suitably carried out using a stoichiometry such that substantially all primary and secondary amines may be converted to tertiary amines. Such amines may have the exemplary structures:

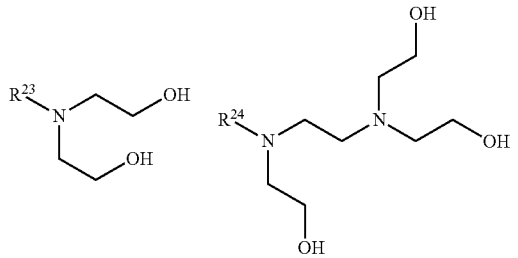

wherein $R^{23}$ and $R^{24}$ may be alkyl groups, or alkyl groups containing sulfur or oxygen linkages, containing from about 10 to 20 carbon atoms. Exemplary ethoxylated amine friction modifiers may include materials in which $R^{23}$ and/or $R^{24}$ may contain from 16 to 20 carbon atoms, e.g., from 16 to 18 carbon atoms. Materials of this type may be commercially available and sold under the tradenames of Ethomeen® and Ethoduomeen® by Akzo Nobel. Suitable materials from Akzo Nobel may include Ethomeen® T/12 and Ethoduomeen® T/13, inter alia.

When present, such ethoxylated amines may be used in any effective amount. Typically, they may be used in amounts from about 0.01 to 1.0 mass percent in the transmission fluid, e.g., from 0.05 to 0.5 mass percent or from 0.1 to 0.3 mass percent.

However, in some embodiments in which the transmission fluid compositions are used in conjunction with hybrid or fully electric engines, the transmission fluid compositions may optionally contain substantially no friction modifiers, or alternatively substantially no friction modifiers of the type(s) described herein.

Molybdenum-Containing Compounds

In some embodiments, the additive package and/or the transmission fluid composition may further comprise one or more oil-soluble or oil-dispersible molybdenum-containing compounds, such as an oil-soluble or oil-dispersible organo-molybdenum compound. In other embodiments, the additive package and/or the transmission fluid composition may further comprise substantially no oil-soluble or oil-dispersible molybdenum-containing compounds.

Non-limiting examples of such oil-soluble or oil-dispersible organo-molybdenum compound may include, but are not necessarily limited to, molybdenum dithiocarbamates, molybdenum dithiophosphates, molybdenum dithiophosphinates, molybdenum xanthates, molybdenum thioxanthates, molybdenum sulfides, and the like, and mixtures thereof, in particular one or more of molybdenum dialkyldithiocarbamates, molybdenum dialkyldithiophosphates, molybdenum alkyl xanthates, and molybdenum alkylthioxanthates. Representative molybdenum alkyl xanthate and molybdenum alkylthioxanthate compounds may be expressed using the formulae of $Mo(R_{25}OCS_2)_4$ and $Mo(R_{25}SCS_2)_4$, respectively, wherein each $R_{25}$ may independently be an organo group selected from the group consisting of alkyl, aryl, aralkyl, and alkoxyalkyl, generally having from 1 to 30 carbon atoms or from 2 to 12 carbon atoms, in particular each being an alkyl group having from 2 to 12 carbon atoms.

In some embodiments, the oil-soluble or oil-dispersible organo-molybdenum compound may comprise a molybdenum dithiocarbamate, such as a molybdenum dialkyldithiocarbamate, and/or may be substantially free from molybdenum dithiosphosphates, in particular from molybdenum dialkyldithiophosphates. In some embodiments, any oil-soluble or oil-dispersible molybdenum compounds may consist of a molybdenum dithiocarbamate, such as a molybdenum dialkyldithiocarbamate, and/or a molybdenum dithiophosphate, such as a molybdenum dialkyldithiophosphate, as the sole source(s) of molybdenum atoms in the composition. In either set of embodiments, when present, the oil-soluble or oil-dispersible molybdenum compound may consist essentially of a molybdenum dithiocarbamate, such as a molybdenum dialkyldithiocarbamate, as the sole source of molybdenum atoms in the transmission fluid.

The molybdenum compound, when present, may be mono-, di-, tri-, or tetra-nuclear, in particular comprising or being di-nuclear and/or tri-nuclear molybdenum compounds.

Suitable dinuclear or dimeric molybdenum dialkyldithiocarbamates, for example, can be represented by the following formula:

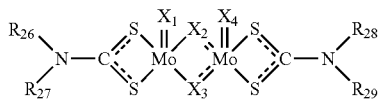

where $R_{26}$ through $R_{29}$ may each independently represent a straight chain, branched chain, or aromatic hydrocarbyl group having 1 to 24 carbon atoms, and where Xi through $X_4$ may each independently represent an oxygen atom or a sulfur atom. The four hydrocarbyl groups, $R_{26}$ through $R_{29}$, may be identical to, or different from, each other.

Suitable tri-nuclear organo-molybdenum compounds may include those having the formula: $Mo_3S_kL_nQ_z$, and mixtures thereof. In such ti-nuclear formula, the three molybdenum atoms may be linked to multiple sulfur atoms (S), with k varying from 4 through 7. Additionally, each L may be an independently selected organic ligand having a sufficient number of carbon atoms to render the compound oil-soluble or oil-dispersible, with n being from 1 to 4. Further, when z is non-zero, Q may be selected from the group of neutral electron donating compounds such as water, amines, alcohols, phosphines, and/or ethers, with z ranging from 0 to 5 and including non-stoichiometric (non-integer) values.

In such tri-nuclear formula, at least 21 total carbon atoms (e.g., at least 25, at least 30, or at least 35) may typically be present among the combination of all ligands ($L_n$). Importantly, however, the organic groups of the ligands may advantageously collectively exhibit a sufficient number of carbon atoms to render the compound soluble or dispersible in the oil. For example, the number of carbon atoms within each ligand L may generally range from 1 to 100, e.g., from 1 to 30 or from 4 to 20.

Tri-nuclear molybdenum compounds having the formula $Mo_3S_kL_nQ_z$ may advantageously exhibit cationic cores surrounded by anionic ligands, such as represented by one or both of the following structures:

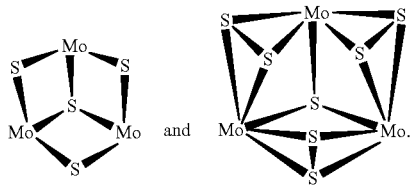

Such cationic cores may each have a net charge of +4 (e.g., due to the oxidation state of the Mo atoms each being +4). Consequently, in order to solubilize these cores, the total charge among all the ligands should correspond, in this case being −4. Four mono-anionic ligands may offer an advantageous core neutralization. Without wishing to be bound by any theory, it is believed that two or more tri-nuclear cores may be bound or interconnected by means of one or more ligands, and the ligands may be multidentate. This includes the case of a multidentate ligand having multiple connections to a single core. Oxygen and/or selenium may be substituted for some portion of the sulfur atoms in either of the cores.

As ligands for the tri-nuclear cores described above, non-limiting examples may include, but are not necessarily limited to, dithiophosphates such as dialkyldithiophosphate, xanthates such as alkylxanthate and/or alkylthioxanthate, dithiocarbamates such as dialkyldithiocarbamate, and combinations thereof, in particular each comprising or being dialkyldithiocarbamate. Additionally or alternatively, the ligands for the tri-nuclear molybdenum-containing cores may independently be one or more of the following:

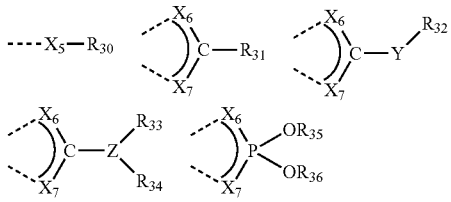

where $X_5$, $X_6$, $X_7$, and Y are each independently oxygen or sulfur, where Z is nitrogen or boron, and wherein $R_{30}$, $R_{31}$, $R_{32}$, $R_{33}$, $R_{34}$, $R_{35}$, and $R_{36}$ are each independently hydrogen or an organic (carbon-containing) moiety, such as a hydrocarbyl group, that may be the same or different from each other, in particular the same. Exemplary organic moieties may include or be alkyl (e.g., in which the carbon atom attached to the remainder of the ligand is primary or secondary), aryl, substituted aryl, alkaryl, substituted alkaryl, aralkyl, substituted aralkyl, an ether, a thioether, or a combination or reaction product thereof, in particular alkyl.

Oil-soluble or oil-dispersible tri-nuclear molybdenum compounds can be prepared by reacting in the appropriate liquid(s)/solvent(s) a molybdenum source such as $(NH_4)_2Mo_3S_{13}.n(H_2O)$, where n varies from 0 to 2 including non-stoichiometric (non-integer) values, with a suitable ligand source, such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source, such as tetralkylthiuram disulfide, a dialkyldithiocarbamate, or a dialkyldithiophosphate, and a sulfur abstracting agent, such as cyanide ions, sulfite ions, or substituted phosphines. Alternatively, a trinuclear molybdenum-sulfur halide salt such as $[M']_2[Mo_3S_7A_6]$, where M' is a counter ion and A is a halogen such as Cl, Br, or I, may be reacted with a ligand source such as a dialkyldithiocarbamate or a dialkyldithiophosphate in an appropriate liquid/solvent (system) to form an oil-soluble or oil-dispersible trinuclear molybdenum compound. The appropriate liquid/solvent (system) may be, for example, aqueous or organic.

Other molybdenum precursors may include acidic molybdenum compounds. Such compounds may react with a basic nitrogen compound, as measured by ASTM D-664 or D-2896 titration procedure, and may typically be hexavalent. Examples may include, but are not necessarily limited to, molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide, or similar acidic molybdenum compounds, or combinations thereof. Thus, additionally or alternatively, the compositions of the present disclosure can be provided with molybdenum, when desired, by molybdenum/sulfur complexes of basic nitrogen compounds as described, for example, in U.S. Pat. Nos. 4,263,152, 4,285,822, 4,283,295, 4,272,387, 4,265,773, 4,261,843, 4,259,195, and 4,259,194, and/or in PCT Publication No. WO 94/06897.

When present, molybdenum-containing compounds may be present in the transmission fluid composition in an amount from 0.1 to 2.0% by mass, based on the total mass of the composition, from 0.1 to 1.5% by mass, from 0.2 to 1.2% by mass, or from 0.2% to 0.8% by mass. Additionally or alternatively, when present, molybdenum-containing compounds may provide the transmission fluid composition with from 50 to 1000 parts per million by mass of molybdenum, based on the total mass of the composition, from 50 to 800 ppm, from 100 to 650 ppm, or from 100 to 500 ppm. Molybdenum content can be measured in accordance with ASTM D5185.

Zinc-Based Phosphorus-Containing Compounds

In some embodiments, the additive package and/or the transmission fluid composition may further comprise one or more zinc-based phosphorus-containing compounds, such as one or more zinc dihydrocarbyl dithiophosphate compounds. Such compounds are known in the art and often referred to as ZDDP. In other embodiments, the additive package and/or the transmission fluid composition may further comprise substantially no zinc-based phosphorus-containing compounds.

ZDDP compounds may be prepared in accordance with known techniques, such as by first forming a dihydrocarbyl dithiophosphoric acid (DDPA), usually by reaction of one or more alcohols or a phenol with $P_2S_5$, and then neutralizing the formed DDPA with a zinc compound. For example, a dithiophosphoric acid may be made by reacting mixtures of primary and secondary alcohols. Alternatively, dithiophosphoric acids can be prepared where the hydrocarbyl groups are entirely secondary in character or the hydrocarbyl groups are entirely primary in character. To make the zinc salt, any basic or neutral zinc compound may be used, but oxides, hydroxides, and carbonates are typically employed. Commercial additives, when used, may frequently contain an excess of zinc, due to the use of an excess of the basic zinc compound in the neutralization reaction.

Advantageous zinc dihydrocarbyl dithiophosphates may comprise or be oil-soluble salts of dihydrocarbyl dithiophosphoric acids, such as represented by the following formula:

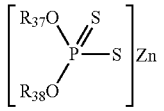

wherein $R_{37}$ and $R_{38}$ may be the same or different hydrocarbyl radicals containing from 1 to 18 (e.g., from 2 to 12 or from 2 to 8) carbon atoms, examples of which hydrocarbyl radicals may include one or more of alkyl, alkenyl, aryl, arylalkyl, alkaryl, and cycloaliphatic radicals. Exemplary hydrocarbyl radicals may comprise or be, but are not necessarily limited to, ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, benzyl, butylphenyl, cyclohexyl, methylcyclopentyl, propenyl, butenyl, and combinations thereof. In order to obtain and/or maintain oil solubility, the total number of carbon atoms on each dihydrocarbyl dithiophosphoric acid ligand (i.e., a single Rr and Ru pair) may generally be at least about 5. In particular, the zinc dihydrocarbyl dithiophosphate can therefore comprise or be a zinc dialkyl dithiophosphate.

When desired, one or more ZDDP compounds may be present in the transmission fluid composition in an amount from 0.4 to 5.0% by mass, based on the total mass of the composition, e.g., from 0.6 to 3.5% by mass, from 1.0 to 3.0% by mass, or from 1.2 to 2.5% by mass. Additionally or alternatively, when present, ZDDP compounds may individually provide the transmission fluid composition with from 300 to 4000 parts per million by mass of phosphorous, based on the total mass of the composition, e.g., from 500 to 2500 ppm, from 750 to 2000 ppm, or from 800 to 1600 ppm. Further additionally or alternatively, when present, ZDDP compounds may provide the transmission fluid composition with from 400 to 4500 parts per million by mass of zinc, based on the total mass of the composition, e.g., from 500 to 3000 ppm, from 800 to 2600 ppm, or from 1000 to 2200 ppm. Zinc and phosphorus content can each be measured in accordance with ASTM D5185.

Other Additive

Other additives known in the art may optionally be added to the transmission fluids, such as other anti-wear agents, extreme pressure additives, viscosity modifiers, and the like. They are typically disclosed in, for example, "Lubricant Additives" by C. V. Smallheer and R. Kennedy Smith, 1967, pp 1-11.

Transmission Fluid Composition

As mentioned herein, transmission fluid compositions according to the present disclosure may advantageously contain a major amount of a lubricating oil basestock and a minor amount of a combination of additives, such as in an additive package, comprising Components (i), (ii), (iii), (iv), and optionally co-additives, such as a corrosion inhibitor, one or more antioxidants, and one or more friction modifiers, as well as others enumerated herein. Such transmission fluid compositions may advantageously be useful in controlling and/or reducing wear during operation of vehicle drivetrain components, such as transmissions, as well as in cooling and/or insulating electric/electronic components of a partially- or fully-electric motor with which the fluid compositions are also in contact. As such, the present disclosure also includes a method of controlling and/or reducing wear in a transmission powered by a hybrid electric or fully electric motor and simultaneously cooling at least a portion of electrical or electronic components of a hybrid electric- or fully electric-powered drivetrain, the method comprising lubricating the transmission and contacting one or more electrical or electronic components of the drivetrain with a transmission fluid composition according to the present disclosure. Further, the present disclosure further provides for the use of a transmission fluid composition according to the present disclosure, or more specifically the use of an additive package containing either the combination of Components (i), (ii), (iii), and (iv) or the combination of Components (iv) and (v) (optionally with or without Component (iii)) in a transmission fluid composition to control and/or reduce wear in a hybrid electric- or fully electric-powered transmission lubricated by the transmission fluid composition and simultaneously to cool at least a portion of electrical or electronic components of a hybrid electric- or fully electric-powered drivetrain contacted by the transmission fluid composition.

The transmission fluid composition may advantageously exhibit good/superior volume resistivity, when used in contact with electrical/electronic components of an at least partially electric-powered engine. In the present disclosure, volume resistivity was calculated from conductivity measurements made using EMCEE Model 1152 conductivity probes, e.g., commercially available from Emcee Electronics, Inc., of Venice, Fla., USA, either (i) factory calibrated according to ASTM D2624-15, or (ii) used in tandem with a Baur DTLC apparatus/rig, commercially available from Baur GmbH of Sulz, Austria, following the procedures outlined in ASTM D1169-11 (specifying ~80° C. and ~500V) and calibrated using Toyota ATF WS automatic transmission fluid (commercially available from Sansone Toyota of Avenel, N.J.) at ~80° C. The conductivities were measured, and therefore the resistivities were calculated, at temperatures of about 80° C. instead of at about 40° C. or about 20° C., in order to more closely simulate operating temperatures under which the engine would be at higher risk of a short-circuit event than at low/resting temperatures. At least two or three volume resistivity measurements were conducted on each sample, in order to get an average volume resistivity value. Advantageously, the transmission fluid compositions according to the present disclosure may exhibit an average volume resistivity (VR) at ~80° C. of at least 44.0 MΩ·m (e.g., at least 44.5 MΩ·m, at least 45.0 MΩ·m, at least 45.5 MΩ·m, at least 46.0 MΩ·m, at least 46.5 MΩ·m, at least 47.0 MΩ·m, or at least 47.5 MΩ·m; in particular, at least 46.0 MΩ·m or at least 47.0 MΩ·m), and optionally up to 500 MΩ·m (e.g., up to 400 MΩ·m, up to 350 MΩ·m, up to 325 MΩ·m, up to 300 MΩ·m, up to 250 MΩ·m, up to 200 MΩ·m, up to 150 MΩ·m, up to 120 MΩ·m, up to 95.0 MΩ·m, up to 90.0 MΩ·m, up to 85.0 MΩ·m, up to 80.0 MΩ·m, up to 76.0 MΩ·m, up to 72.0 MΩ·m, up to 68.0 MΩ·m, or up to 65.0 MΩ·m; in particular, up to 350 MΩ·m, up to 325 MΩ·m, up to 95.0 MΩ·m, up to 72.0 MΩ·m, or up to 65.0 MΩ·m).

Additionally or alternatively, the transmission fluid composition may advantageously exhibit good/superior wear properties, in particular via a needle-bearing fatigue test (NBFT) for wear lifetime, when used as a lubricant. In the present disclosure, although NBFT lifetime can be obtained via various methods, the NBFT lifetimes discussed herein used the apparatus and procedures disclosed in the Examples section. Advantageously, the transmission fluid compositions according to the present disclosure may exhibit an average needle-bearing fatigue (NBFT) lifetime of at least 13.0 Megacycles (e.g., at least 13.5 Megacycles, at least 14.0 Megacycles, at least 14.5 Megacycles, at least 15.0 Megacycles, at least 15.5 Megacycles, at least 16.0 Megacycles, at least 16.5 Megacycles, at least 17.0 Megacycles, at least 17.5 Megacycles, at least 18.0 Megacycles, at least 18.5 Megacycles, at least 19.0 Megacycles, at least 19.5 Megacycles, or at least 20.0 Megacycles; in particular, at least 13.5 Megacycles, at least 14.0 Megacycles, at least 17.0 Megacycles, or at least 20.0 Megacycles), and optionally up to 70.0 Megacycles (e.g., up to 60.0 Megacycles, up to 50.0 Megacycles, up to 40.0 Megacycles, up to 35.0 Megacycles, up to 30.0 Megacycles, up to 27.0 Megacycles, up to 24.0 Megacycles, up to 22.0 Megacycles, up to 21.0 Megacycles, or up to 20.0 Megacycles; in particular up to 50.0 Megacycles, up to 30.0 Megacycles, up to 24.0 Megacycles, or up to 22.0 Megacycles).

Advantageously, any of the transmission fluid compositions of the present disclosure may exhibit a kinematic viscosity at 100° C. (KV100), as measured by ASTM D445, of up to 10 cSt (e.g., up to 8.0 cSt, up to 7.0 cSt, up to 6.5 cSt, up to 6.0 cSt, up to 5.5 cSt, up to 5.0 cSt, up to 4.5 cSt, up to 4.0 cSt, up to 3.5 cSt, up to 3.0 cSt, up to 2.5 cSt, up to 2.0, from 1.0 cSt to 10 cSt, from 1.0 cSt to 8.0 cSt, from 1.0 cSt to 7.0 cSt, from 1.0 cSt to 6.5 cSt, from 1.0 cSt to 6.0 cSt, from 1.0 cSt to 5.5 cSt, from 1.0 cSt to 5.0 cSt, from 1.0 cSt to 4.5 cSt, from 1.0 cSt to 4.0 cSt, from 1.0 cSt to 3.5 cSt, from 1.0 cSt to 3.0 cSt, from 1.0 cSt to 2.5 cSt, from 1.0 cSt to 2.0 cSt, from 1.5 cSt to 10 cSt, from 1.5 cSt to 8.0 cSt, from 1.5 cSt to 7.0 cSt, from 1.5 cSt to 6.5 cSt, from 1.5 cSt to 6.0 cSt, from 1.5 cSt to 5.5 cSt, from 1.5 cSt to 5.0 cSt, from 1.5 cSt to 4.5 cSt, from 1.5 cSt to 4.0 cSt, from 1.5 cSt to 3.5 cSt, from 1.5 cSt to 3.0 cSt, from 1.5 cSt to 2.5 cSt, from 2.0 cSt to 10 cSt, from 2.0 cSt to 8.0 cSt, from 2.0 cSt to 7.0 cSt, from 2.0 cSt to 6.5 cSt, from 2.0 cSt to 6.0 cSt, from 2.0 cSt to 5.5 cSt, from 2.0 cSt to 5.0 cSt, from 2.0 cSt to 4.5 cSt, from 2.0 cSt to 4.0 cSt, from 2.0 cSt to 3.5 cSt, from 2.0 cSt to 3.0 cSt, from 2.0 cSt to 2.5 cSt, from 2.5 cSt to 10 cSt, from 2.5 cSt to 8.0 cSt, from 2.5 cSt to 7.0 cSt, from 2.5 cSt to 6.5 cSt, from 2.5 cSt to 6.0 cSt, from 2.5 cSt to 5.5 cSt, from 2.5 cSt to 5.0 cSt, from 2.5 cSt to 4.5 cSt, from 2.5 cSt to 4.0 cSt, from 2.5 cSt to 3.5 cSt, from 2.5 cSt to 3.0 cSt, from 3.0 cSt to 10 cSt, from 3.0 cSt to 8.0 cSt, from 3.0 cSt to 7.0 cSt, from 3.0 cSt to 6.5 cSt, from 3.0 cSt to 6.0 cSt, from 3.0 cSt to 5.5 cSt, from 3.0 cSt to 5.0 cSt, from 3.0 cSt to 4.5 cSt, from 3.0 cSt to 4.0 cSt, from 3.0 cSt to 3.5 cSt, from 3.5 cSt to 10 cSt, from 3.5 cSt to 8.0 cSt, from 3.5 cSt to 7.0 cSt, from 3.5 cSt to 6.5 cSt, from 3.5 cSt to 6.0 cSt, from 3.5 cSt to 5.5 cSt, from 3.5 cSt to 5.0 cSt, from 3.5 cSt to 4.5 cSt, from 3.5 cSt to 4.0 cSt, from 4.0 cSt to 10 cSt, from 4.0 cSt to 8.0 cSt, from 4.0 cSt to 7.0 cSt, from 4.0 cSt to 6.5 cSt, from 4.0 cSt to 6.0 cSt, from 4.0 cSt to 5.5 cSt, from 4.0 cSt to 5.0 cSt, or from 4.0 cSt to 4.5 cSt), in particular from 1.0 cSt to 10 cSt, from 2.0 cSt to 8.0 cSt, from 1.5 cSt to 3.5 cSt, or from 2.5 cSt to 5.0 cSt.

Alternative Formulations

In some embodiments, instead of the specific combination of components (i), (ii), (iii), and (iv), combinations of components (iv) and (v) (e.g., substantially in the absence of both components (i) and (ii)) can alternatively provide a combination of wear protection and volume resistivity. Such alternative embodiments may optionally contain substantially no (e.g., no intentionally added) calcium salicylate detergent of component (iii), substantially no (e.g., no intentionally added) additional nitrogen-containing ashless dispersant (e.g., having structure (IV)), or both. In some such embodiments containing substantially no calcium salicylate detergent of component (iii), the alternatively formulations may optionally also contain substantially no substantially no (e.g., no intentionally added) magnesium salicylate detergents, substantially no (e.g., no intentionally added) calcium and/or magnesium sulfonate detergents, substantially no (e.g., no intentionally added) calcium and/or magnesium phenate detergents, and combinations thereof (in some cases, containing substantially no (e.g., no intentionally added) detergents of any kind).

Component (v) may advantageously comprise one or more dihydrocarbyl hydrogen phosphite compounds having the structure H—P(=O)—$(OR_{39})_2$, which may be in equilibrium with the structure HO—P—$(OR_{39})_2$, in which each $R_{39}$ may independently comprise or be straight, branched, and/or cyclic alkyl, alkenyl, alkynyl, alkadienyl, and/or alkatrienyl groups having 12 to 24 carbon atoms containing no thioether linkages (i.e., different from the phosphorus-containing structures (I) of component (i), in which at least some of the alkyl chains are interrupted by a thioether linkage). For example, each $R_{39}$ alkyl moiety may be the same or different and may each independently comprise straight and/or branched alkyl and/or alkenyl groups having from 14 to 22 carbon atoms (such as from 16 to 18 carbon atoms).

In particular, when present, dihydrocarbyl hydrogen phosphite compounds of component (v) may collectively be present in the transmission fluid composition in an amount from 0.05 to 2.0% by mass, based on the total mass of the composition, e.g., from 0.1 to 1.4% by mass, from 0.2 to 1.0% by mass, or from 0.25 to 0.8% by mass. Additionally or alternatively, in particular, dihydrocarbyl hydrogen phosphite compounds of component (v), when present, may collectively provide the transmission fluid composition with from 35 to 2200 parts per million by mass of phosphorous, based on the total mass of the composition, e.g., from 50 to 2000 ppm, from 100 to 1000 ppm, or from 300 to 750 ppm. Phosphorus content can be measured in accordance with ASTM D5185.

Such alternative formulations containing a combination of components (iv) and (v) may advantageously exhibit similar average volume resistivity properties and/or average needle-bearing fatigue (NBFT) lifetime properties to those formulations described herein containing a combination of components (i), (ii), (iii), and (iv).

Additional Embodiments

Additionally or alternatively, the present disclosure may include one or more of the following embodiments.

Embodiment 1. A transmission fluid composition comprising: a major amount of a lubricating oil basestock; and a minor amount of an additive package comprising: (i) a mixture comprising two or more compounds of structures (1):

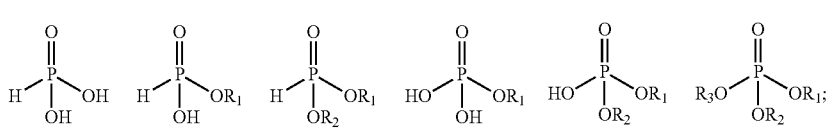

(I)

wherein groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms in which the alkyl chain is interrupted by a thioether linkage; ii one or more compounds of structures (II):

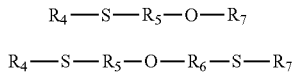

(II)

wherein groups $R_4$ and $R_7$ are independently alkyl groups having 1 to 12 carbon atoms and $R_5$ and $R_6$ are independently alkyl linkages having 2 to 12 carbon atoms; (iii) a detergent comprising calcium salicylate; and (iv) a basic nitrogen-containing ashless dispersant comprises one or more compounds of structure (III):

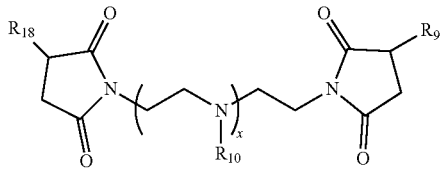

(III)

wherein: $R_8$ and $R_9$ are each independently a hydrocarbon group made by the metallocene-catalyzed polymerization of an α-olefin feedstock comprising 1-butene, 1-pentene, 1-hexene, 1-heptene, 1-octene, 1-nonene, 1-decene, 1-undecene, I-dodecene, I-tetradecene, 1-octadecene, or mixtures thereof (in particular, consisting essentially of 1-octene, 1-decene, 1-dodecene, or mixtures thereof); each $R_{10}$ is independently hydrogen, an acetyl moiety, or a moiety formed by reaction between ethylene carbonate and >N—$R_{10}$ (in particular, a hydrogen or an acyl moiety); and x is from 1 to 10 (in particular, from 3 to 10) and is the same for all molecules of structure (III) or is an average of all molecules of structure (III) in a mixture of molecules of structure (III).

Embodiment 2. A transmission fluid composition according to embodiment 1, wherein the compounds of component (i) and component (ii) are each present in the composition in an amount from 0.05 to 0.5% by mass, based on the total mass of the composition, and/or in a mass ratio of from 2:1 to 1:2.

Embodiment 3. A transmission fluid composition according to embodiment 1 or embodiment 2, wherein component (iii) is present in the composition in an amount from 0.05 to 0.7% by mass, based on the total mass of the composition, and/or provides composition with 45 to 450 parts per million by mass (ppm) of calcium, based on the total mass of the composition.

Embodiment 4. A transmission fluid composition according to any one of the previous embodiments, wherein component (iii) comprises no intentionally added phenate detergent component and/or comprises no intentionally added sulfonate detergent component.

Embodiment 5. A transmission fluid composition according to any one of the previous embodiments, wherein component (iv) is present in the composition in an amount from 0.75 to 5.0% by mass, based on the total mass of the composition, and/or wherein $R_8$ and $R_9$ moieties of the ashless dispersant of component (iv) each independently has a number average molecular weight (Mn) from 300 to 20000 Daltons, as determined by GPC with reference to linear polystyrene standards.

Embodiment 6. A transmission fluid composition according to any one of the previous embodiments, further comprising an additional basic nitrogen-containing ashless dispersant of structure (IV):

(IV)

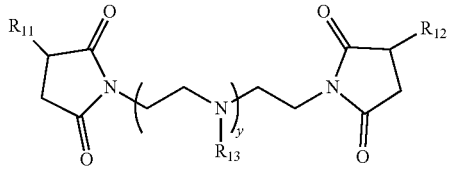

wherein:

$R_{11}$ and $R_{12}$ are each independently a hydrocarbyl group having a number average molecular weight (Mn) from 500 to 5000 Daltons, as determined by GPC with reference to linear polystyrene standards;

each $R_{13}$ is independently hydrogen, an acetyl moiety, or a moiety formed by reaction between ethylene carbonate and >N—$R_{13}$; and y is from 3 to 10 and is the same for all molecules of structure (IV) or is an average of all molecules of structure (IV) in a mixture of molecules of structure (IV).

Embodiment 7. A transmission fluid composition according to embodiment 6, wherein:

$R_{11}$ and $R_{12}$ are each independently a polyisobutenyl moiety having a number average molecular weight (Mn) from 750 to 2500 Daltons, as determined by GPC with reference to linear polystyrene standards; and each $R_{13}$ is independently hydrogen or an acetyl moiety.

Embodiment 8. A transmission fluid composition according to any one of embodiments 1-5, further comprising substantially no other basic nitrogen-containing ashless dispersants other than component (iv).

Embodiment 9. A transmission fluid composition according to any one of the previous embodiments, wherein the composition comprises less than 100 parts per million by mass (ppm) of boron, based on the total mass of the composition.

Embodiment 10. A transmission fluid composition according to any one of the previous embodiments, wherein the lubricating oil basestock comprises a Group III basestock, a Group IV basestock, or a combination thereof.

Embodiment 11. A transmission fluid composition according to any one of the previous embodiments, further comprising a substituted thiadiazole, an aminic antioxidant, a phenolic antioxidant, a corrosion inhibitor, and a friction modifier having the following structure:

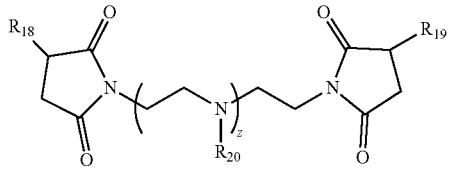

wherein each of $R_{18}$ and $R_{19}$ is independently:

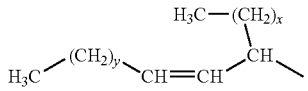

such that x+y is from 8 to 15 and z is an integer from 1 to 5; and wherein each $R_{20}$ is independently hydrogen, an acetyl moiety, or a moiety formed by reaction between ethylene carbonate and >N—$R_{20}$.

Embodiment 12. A transmission fluid composition according to any one of the previous embodiments, wherein: the lubricating oil basestock exhibits a kinematic viscosity at 100° C. (KV100), as measured according to ASTM D445, from 1.5 cSt to 8.1 cSt; the composition exhibits a KV100, as measured according to ASTM D445, from 2 cSt to 6.5 cSt the composition exhibits an average volume resistivity at about 80° C. of at least 46.0 MΩ·m; and the composition exhibits an average needle-bearing fatigue lifetime of at least 13.0 Megacycles.

Embodiment 13. A transmission fluid composition according to any one of the previous embodiments, wherein the composition exhibits one or more of: an average volume resistivity at about 80° C. of at least 47.0 MΩ·m and an average needle-bearing fatigue lifetime of at least 14.0 Megacycles; an average volume resistivity at about 80° C. of up to 95.0 MΩ·m and an average needle-bearing fatigue lifetime of up to 30.0 Megacycles; and an average volume resistivity at about 80° C. of up to 72.0 MΩ·m and an average needle-bearing fatigue lifetime of up to 25.0 Megacycles.

Embodiment 14. A transmission fluid composition comprising: a major amount of a lubricating oil basestock, such as comprising a Group III basestock, a Group IV basestock, or a combination thereof; and a minor amount of an additive package comprising: (iv) a basic nitrogen-containing ashless dispersant comprises one or more compounds of structure (III):

(III)

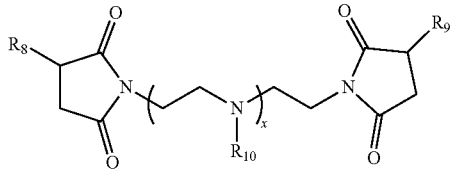

wherein: $R_8$ and $R_9$ are each independently a hydrocarbon group made by the metallocene-catalyzed polymerization of an α-olefin feedstock comprising 1-butene, 1-pentene, 1-hexene, 1-heptene, 1-octene, 1-nonene, 1-decene, 1-undecene, 1-dodecene, 1-tetradecene, 1-octadecene, or mixtures thereof (in particular, consisting essentially of 1-octene, 1-decene, 1-dodecene, or mixtures thereof); each $R_{10}$ is independently hydrogen, an acetyl moiety, or a moiety formed by reaction between ethylene carbonate and >N—$R_{10}$ (in particular, a hydrogen or an acyl moiety); and x is from 1 to 10 (in particular, from 3 to 10) and is the same for all molecules of structure (III) or is an average of all molecules of structure (III) in a mixture of molecules of structure (III); and (v) one or more dihydrocarbyl hydrogen phosphite compounds having a structure H—P(=O)—$(OR_{39})_2$, in which each $R_{39}$ independently comprises or is an alkyl group having 12 to 24 carbon atoms (for example from 14 to 22 carbon atoms or from 16 to 18 carbon atoms).

Embodiment 15. A transmission fluid composition according to embodiment 14, further comprising one or more of the following: no intentionally added components (i) and (ii); substantially no intentionally added component (iii); substantially no other basic nitrogen-containing ashless dispersants other than component (iv); and less than 50 parts per million by mass (ppm) of boron, based on the total mass of the composition.

Embodiment 16. A transmission fluid composition according to embodiment 14 or embodiment 15, further comprising a substituted thiadiazole, an aminic antioxidant, a phenolic antioxidant, a corrosion inhibitor, and at least two friction modifiers, at least one of which having the following structure:

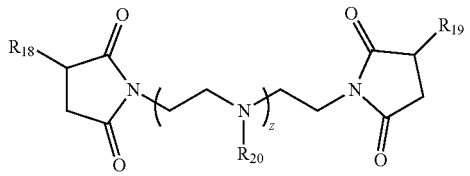

wherein each of $R_{18}$ and $R_{19}$ is independently:

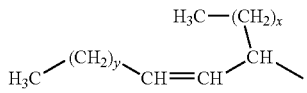

such that x+y is from 8 to 15 and z is an integer from 1 to 5; and wherein each $R_{20}$ is independently hydrogen, an acetyl moiety, or a moiety formed by reaction between ethylene carbonate and >N—$R_{20}$.

Embodiment 17. A transmission fluid composition according to any one of embodiments 14-16, wherein: the lubricating oil basestock exhibits a kinematic viscosity at 100° C. (KV100), as measured according to ASTM D445, from 1.5 cSt to 3.3 cSt; the composition exhibits a KV40, as measured according to ASTM D445, from 9.1 cSt to 11.4 cSt; the composition exhibits an average volume resistivity at about 80° C. of at least 46.0 MΩ·m; the composition exhibits an average volume resistivity at about 80° C. of up to 350 MΩ·m; the composition exhibits an average needle-bearing fatigue lifetime of at least 14.0 Megacycles; and optionally the composition exhibits an average needle-bearing fatigue lifetime of up to 22.0 Megacycles.

Embodiment 18. A transmission fluid composition according to any one of embodiments 14-17, wherein component (iv) is present in the composition in an amount from 0.75 to 5.0% by mass, based on the total mass of the composition, and/or wherein $R_8$ and $R_9$ moieties of the ashless dispersant of component (iv) each independently has a number average molecular weight (Mn) from 300 to 20000 Daltons, as determined by GPC with reference to linear polystyrene standards.

Embodiment 19. A method of controlling or reducing wear in a transmission powered by a hybrid electric or fully electric motor and simultaneously cooling at least a portion of electrical or electronic components of a hybrid electric- or fully electric-powered drivetrain, the method comprising lubricating the transmission and contacting one or more electrical or electronic components of the drivetrain with a transmission fluid composition according to any one of the previous embodiments.

Embodiment 20. The use of a transmission fluid composition according to any one of embodiments 1-18 to control or reduce the wear in a hybrid electric- or fully electric-powered transmission lubricated by the composition and simultaneously to cool at least a portion of electrical or electronic components of a hybrid electric- or fully electric-powered drivetrain contacted by the composition.

The invention will now be described by way of non-limiting examples only.

Examples

The following components were used to form transmission fluid compositions according to the present disclosure, as well as certain comparative examples.

The following Component (i) compounds represented at least 3.0 wt % of the total mass of compounds fitting within structure (I) in transmission fluid compositions according to the present disclosure:

(a)

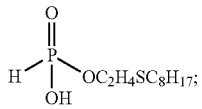

(b)

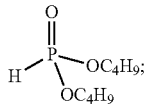

(c)

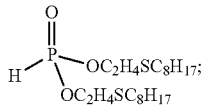

and (d)

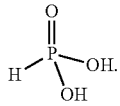

There were at least three (3) other compounds falling within Component (i) but representing less than 3.0 wt % of the total mass of compounds fitting within structure (I) in the transmission fluid compositions. Compounds (a) and (c), i.e., compounds containing an alkyl group where the alkyl chain is interrupted by a thioether linkage, collectively represented more than 40% (e.g., more than 45%) by mass of all Component (i) structure (I) compounds.

The following Component (ii) compounds represented at least 3.0 wt % of the total mass of compounds fitting within structure (II) in transmission fluid compositions according to the present disclosure:

$C_8H_{17}$—S—$C_2H_4$—O—$C_4H_9$; and (e)

$C_8H_{17}$—S—$C_2H_4$—O—$C_2H_4$—S—$C_8H_{17}$ (f).

There were at least two (2) other compounds falling within Component (i) but representing less than 3.0 wt % of the total mass of compounds fitting within structure (II) in the transmission fluid compositions.

Component (iii) was an overbased alkyl-substituted calcium salicylate detergent, although certain comparative examples herein were formulated with an overbased calcium sulfonate substituted for the salicylate detergent of Component (iii).

Component (iv) was an mPAO-endcapped poly(alkyleneamine) succinimide-based ashless dispersant having structure (III):

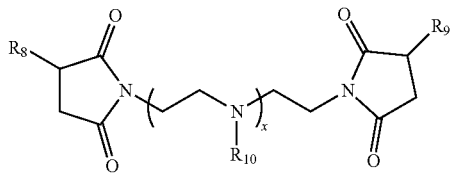

(III)

in which $R_8$ and $R_9$ are each independently a hydrocarbon group made by the metallocene-catalyzed polymerization of an α-olefin feedstock consisting essentially of 1-octene, 1-decene, 1-dodecene, or mixtures thereof; in which each $R_{10}$ is independently hydrogen; and in which x is from 3 to 10 and is the same for all molecules of structure (III) or is an average of all molecules of structure (III) in a mixture of molecules of structure (III). Each of $R_8$ and $R_9$ independently had a number average molecular weight of between 500 and 2500 Daltons, as determined by GPC with reference to linear polystyrene standards.

A mixture of compounds of Component (i) can be prepared by placing di-butyl phosphite (~194 grams, ~2 moles) into a round-bottomed, 4-neck flask equipped with a reflux condenser, a stirring bar, and a nitrogen bubbler. The flask may then be flushed with nitrogen, sealed, and the stirrer started. The di-butyl phosphite may then be heated to ~150° C. under vacuum and maintained at temperature while hydroxyethyl n-octyl sulfide (~280 grams, ~2 moles) may be added over a period of time, such as about 1 hour. Heating may be continued following the addition of the hydroxyethyl n-octyl sulfide until butyl alcohol is no longer generated. The reaction mixture may then be cooled and the mixed product obtained.

A mixture of compounds of Component (ii) can be prepared by combining hydroxyethyl n-octyl sulfide (~190 grams, ~1 mole) and n-butyl alcohol (~74 grams, ~1 mole) in a round-bottomed, 4-neck flask equipped with an overheads receiver, a stirring bar, and a nitrogen bubbler. A catalytic amount of a suitable acid catalyst (e.g., phosphorus acid) may then be added. The flask may then be flushed with nitrogen, sealed, and the stirrer started. The reaction mixture may then be heated to ~150° C. at approximately atmospheric pressure and maintained there until ~0.5 mole of water (~9 grams) can be collected in the receiver. The reaction mixture may then be cooled to obtain the product.

Tables 1-2 below detail some of the transmission fluid compositions prepared. Amounts of components (i), (ii), (iii), and (iv) are expressed in mass %, and phosphorus, boron, and calcium contents are expressed in parts per million by mass, all based on the mass of the composition. The "Other Additives" was a combination of co-additives typically found in transmission fluid additive packages and included, but was not limited to, a thiadiazole, an aminic antioxidant, a phenolic antioxidant, a corrosion inhibitor, a friction modifier, and a basestock oil diluent. Any variation in the amount of "Other Additives" used in each example was to balance the amounts of the other components and was due only to differences in the amount of basestock oil diluent. Collectively, Components (i), (ii), (iii), and (iv), as well as the Other Additives, are referred to herein as the Additive Package. All of the active (non-diluent) components in the Additive Package were used at approximately the same concentrations in each example. The basestock oil diluent with which each additive package sample was diluted to form exemplary the transmission fluid compositions was a Group IV basestock (or a mixture of Group IV basestocks collectively) exhibiting a KV100 from ~2.7 cSt ($mm^2$/sec) to ~8.1 cSt.

TABLE 1

| Component | Comp. Ex. 1 | Comp. Ex. 2 | Comp. Ex. 3 | Comp. Ex. 4 |
|---|---|---|---|---|
| (i) structure (I) | 0.182 | 0.182 | 0.182 | 0.182 |
| (ii) structure (II) | 0.126 | 0.126 | 0.126 | 0.126 |
| (iii) calcium salicylate[1] | 0.100 | 0.100 | — | — |
| calcium sulfonate[1] | — | — | 0.100 | 0.100 |
| (iv) mPAO-PAM[1] | — | — | — | 1.30 |
| borated PIB-PAM | 2.97 | 2.97 | 2.97 | 2.97 |
| unborated PIB-PAM[1] | — | 1.30 | — | — |
| Other Additives | 4.61 | 5.31 | 4.61 | 5.31 |
| Addpack KV100 [cSt] | 24.4 | 41.8 | 20.5 | 30.7 |
| Basestock/diluent | balance | balance | balance | balance |
| phosphorus [ppm] | 300 | 300 | 300 | 300 |
| boron [ppm] | 69 | 69 | 69 | 69 |
| calcium [ppm] | 125 | 125 | 116 | 116 |
| avg. volume resistivity* @~80° C. [MΩ · m] | 40.0 | 43.8 | 40.7 | 43.5 |
| fluid KV100 [cSt] | 4.76 | 4.87 | 4.60 | 4.76 |

[1]amounts shown are as components, which include ~25-55 mass % diluent
*average of 2-3 measurements taken

TABLE 2

| Component | Example 5 | Example 6A | Example 6B | Example 7A | Example 7B |
|---|---|---|---|---|---|
| (i) structure (I) | 0.182 | 0.182 | 0.182 | 0.182 | 0.182 |
| (ii) structure (II) | 0.126 | 0.126 | 0.126 | 0.126 | 0.126 |
| (iii) calcium salicylate[1] | 0.100 | 0.100 | 0.100 | 0.100 | 0.100 |
| calcium sulfonate[1] | — | — | — | — | — |
| (iv) mPAO-PAM[1] | 1.30 | 1.30 | 1.30 | 1.40[2] | 1.40[2] |
| borated PIB-PAM[1] | 2.97 | — | — | — | — |
| unborated PIB-PAM[1] | — | — | — | — | — |
| Other Additives | 5.31 | 6.28 | 6.28 | 6.18 | 6.18 |
| Addpack KV100 [cSt] | 4.76 | 8.97 | 8.97 | 9.37 | 9.37 |
| Basestock/diluent | balance | balance | balance | balance | balance |
| phosphorus [ppm] | 300 | 300 | 300 | 300 | 300 |
| boron [ppm] | 69 | 0 | 0 | 44 | 44 |
| calcium [ppm] | 125 | 125 | 125 | 125 | 125 |
| avg. volume resistivity* @~80° C. [MΩ · m] | 61.5 | 54.6 | 47.6 | 27.8 | 27.8 |
| fluid KV100 [cSt] | 4.76 | 4.23 | 4.77 | 4.24 | 4.77 |

[1]amounts shown are as components, which include ~25-55 mass % diluent
[2]borated
*average of 2-3 measurements taken Comparative Examples 1 and 3 represent transmission fluid formulations, in which borated PIB-PAM-PIB dispersants are paired with anti-wear components (i) and (ii), as well as a calcium salicylate detergent or a calcium sulfonate detergent, respectively. Comparative Example 2 is based on a calcium salicylate detergent, like Comparative Example 1, except it contains a mixture of borated and unborated PIB-PAM-PIB dispersants. Comparative Example 4 is based on a calcium sulfonate detergent, like Comparative Example 3, except it contains a mixture of borated PIB-PAM-PIB and unborated mPAO-PAM-mPAO dispersants. Example 5, however, represents the calcium salicylate detergent-containing analog of Comparative Example 4, including both anti-wear components (i) and (ii) and a mixture of unborated mPAO-PAM-mPAO and borated PIB-PAM-PIB dispersants. Examples 6A and 6B are like Example 5, except both contain only unborated mPAO-PAM-mPAO and no PIB-PAM-PIB dispersant—the difference between Examples 6A and 6B is that a mixture of diluents having different KV100 values were added to attain different fully formulated KV100 values. Examples 7A and 7B are analogous to Examples 6A and 6B, respectively, except that the mPAO-PAM-mPAO dispersant was borated and pre-mixed with anti-wear components (i) and (ii). Each of the mPAO and PIB arms/endcaps of both the mPAO-PAM-mPAO and PIB-PAM-PIB dispersants, respectively, used in the Comparative Examples and the Examples had number average molecular weights from 750 to 2500 Daltons, as determined by GPC with reference to linear polystyrene standards. Additionally, each PAM connector within both the mPAO-PAM-mPAO and PIB-PAM-PIB dispersants, respectively, used in the Comparative Examples and the Examples exhibited an average x (a polyalkyleneamine repeat unit value) from 3 to 10.

Each additive package/fully formulated composition from Tables 1-2 was characterized for KV100, and fully formulated compositions were tested for volume resistivity (reciprocal of volume conductivity) using an Emcee Model 1152-0007 conductivity probe, commercially available from Emcee Electronics, Inc., of Venice, Fla. (USA). A test tube with a ~15-25 mL sample was submerged in a silicone oil bath (~2 L beaker) heated to ~80° C. using a hot plate with a temperature probe submerged in the oil bath. All samples were degassed in a desiccator for at least 72 hours prior to testing. The silicone oil bath was stirred at between ~300 and ~600 rpm using a magnetic stirrer and allowed to equilibrate at elevated temperature for at least 30 minutes before measurements were taken. A hydrogen sulfide detector was oriented above the test tube to ensure that significant degradation of the sample was not occurring. At least two measurements were taken for each sample, with at least 2 minutes between measurements, to confirm accuracy.

It is clear from Tables 1-2 that the beneficial ~80° C. volume resistivity values (i.e., above a particular threshold value) is not inherent, even from the combination of components (i), (ii), (iii), and (iv). For instance, note that Example 1 (containing all four components according to the present disclosure) exhibited superior wear performance. The average VR values from Comparative Examples 1-3, without any component (iv), were uniformly below 44.0 MΩ·m, with no single VR measurement at or above 46.0 MΩ·m. The average VR value from Comparative Example 4, with a calcium sulfonate detergent and dispersant mixture of ~30 wt % component (iii) and the remainder PIBSA-PAM dispersant, is also below 44.0 MΩ·m, with no single VR measurement at or above 46.0 MΩ·m, while Example 5, containing the same dispersant mixture with calcium salicylate detergent component (iii), shows a markedly higher average VR. Examples 6A and 6B, containing calcium salicylate detergent component (iii) and only mPAOSA-PAM dispersant component (iv) but no PIBSA-PAM dispersant, both show average VR values above the Comparative Example threshold. Examples 7A and 7B, despite containing the same categories of components as in Examples 6A and 6B, show average VR values below the Comparative Example threshold. Although the major (but notably not the only) difference between Examples 6 and 7 is the boration of the dispersant, the contrast just shows that mere inclusion of all of components (i), (ii), (iii), and (iv) in a lubricant composition does not inherently produce an average VR above the comparative threshold.

Tables 3-4 below detail some of the transmission fluid compositions prepared. Amounts of components (i), (ii), (iii), and (iv) are expressed in mass %, and phosphorus, boron, and calcium contents are expressed in parts per million by mass, all based on the mass of the composition. The "Other Additives" was a combination of co-additives typically found in transmission fluid additive packages and included, but was not limited to, a thiadiazole, an aminic antioxidant, a phenolic antioxidant, a corrosion inhibitor, at least one friction modifier, and a basestock oil diluent. Any variation in the amount of "Other Additives" used in each example was to balance the amounts of the other components and was due only to differences in the amount of basestock oil diluent. Collectively, Components (i), (ii), (iii), (iv), and (v), as well as the Other Additives, are referred to herein as the Additive Package. Concentrations of the thiadiazole and the antioxidant components in the Additive Packages were maintained as similar across all examples, whereas occasionally (but not uniformly) the total concentrations of the corrosion inhibitor(s), the friction modifier(s), and the basestock(s)/diluent(s) were varied across samples. However, each Additive Package was used at the same treat rate (same dilution ratio) in the fully formulated compositions for all examples and comparative examples in Tables 3-4. The basestock oil diluent with which each additive package sample was diluted to form exemplary the transmission fluid compositions was a Group III or Group IV basestock (or a mixture of Group III and/or Group IV basestocks collectively) exhibiting a KV100 from ~1.5 cSt to ~3.3 cSt, except for Comparative Example 18, which basestock(s) exhibited a KV100 from ~2.7 cSt to ~8.1 cSt (like Comparative Examples 1-4 and Examples 5-7).

TABLE 3

| Component | Comp. Ex. 8 | Comp. Ex. 9 | Example 10 | Example 11 | Example 12 | Example 13 |
|---|---|---|---|---|---|---|
| (i) structure (I) | 0.199 | 0.195 | 0.193 | 0.193 | — | 0.195 |
| (ii) structure (II) | 0.137 | 0.135 | 0.133 | 0.133 | — | 0.135 |
| (iii) calcium salicylate[1] | — | — | — | — | — | 0.050 |
| calcium sulfonate[1] | — | — | — | — | — | — |
| (iv) mPAO-PAM[1] | — | — | 1.30 | 2.00 | 2.00 | 1.00 |
| borated PIB-PAM[1] | 3.24 | 1.06 | 1.05 | 0.350 | — | 0.588 |
| (v) difunctional phosphite | — | — | — | — | 0.550 | — |
| Other Additives | 2.41 | 4.60 | 3.31 | 3.31 | 3.45 | 4.02 |
| Basestock/diluent | balance | balance | balance | balance | balance | balance |

TABLE 3-continued

| Component | Comp. Ex. 8 | Comp. Ex. 9 | Example 10 | Example 11 | Example 12 | Example 13 |
|---|---|---|---|---|---|---|
| phosphorus [ppm] | 250 | 250 | 250 | 250 | 300 | 250 |
| boron [ppm] | 76 | 37 | 36 | 13 | 0 | 21 |
| nitrogen [ppm] | 760 | 640 | 840 | 880 | 790 | 720 |
| calcium [ppm] | 0 | 0 | 0 | 0 | 0 | 63 |
| avg. volume resistivity @~80° C. [MΩ · m] | 35.7 | 21.5 | 31.9 | 51.3 | 336 | 38.0 |
| avg. NBFT life [Mcyc] | 18.8* | 19.0 | 18.6^ | 9.87* | 8.88* | 17.0 |
| fluid KV40 [cSt] | 11.9 | 10.1 | — | — | — | 10.2 |

[1]amounts shown are as components, which include ~25-55 mass % diluent
*only one data point; ^average of only two data points

TABLE 4

| Component | Example 14 | Example 15 | Example 16 | Example 17 | Comp. Ex. 18 |
|---|---|---|---|---|---|
| (i) structure (I) | 0.193 | 0.193 | 0.193 | — | 0.199 |
| (ii) structure (II) | 0.133 | 0.133 | 0.133 | — | 0.137 |
| (iii) calcium salicylate[1] | 0.050 | — | 0.050 | — | — |
| calcium sulfonate[1] | — | — | — | — | 0.100 |
| (iv) mPAO-PAM[1] | 1.00 | 2.00 | 2.00 | 1.00 | — |
| berated PIB-PAM[1] | 0.350 | 0.350 | 0.350 | — | 3.24 |
| (v) difunctional phosphite | — | — | — | 0.550 | — |
| Other Additives | 4.26 | 3.31 | 3.26 | 4.45 | 4.02 |
| Basestock/ diluent | balance | balance | balance | balance | balance |
| phosphorus [ppm] | 250 | 250 | 250 | 300 | 265 |
| boron [ppm] | 13 | 13 | 13 | 0 | 76 |
| nitrogen [ppm] | 680 | 840 | 840 | 620 | 2160 |
| calcium [ppm] | 63 | 0 | 63 | 0 | 116 |
| avg. volume resistivity @~80° C. [MΩ · m] | 50.0 | 47.1 | 59.5 | 320 | 42.0 |
| avg. NBFT life [Mcyc] | 23.4 | 14.6 | 21.8 | 19.4 | 11.9 |
| fluid KV40 [cSt] | 10.1 | 9.5 | 10.9 | 10.1 | 23.6 |

[1]amounts shown are as components, which include ~25-55 mass % diluent

Comparative Examples 8 and 9 represent transmission fluid formulations, in which different amounts of borated PIB-PAM-PIB dispersants, respectively, are paired with anti-wear components (i) and (ii), but without an mPAO-PAM-mPAO dispersant component (iv) and without a calcium salicylate detergent component (iii) (and indeed without any detergent). They serve as lower viscosity analogs of Comparative Examples 1-3 above. Examples 10, 11, and 15 show dispersant mixtures of borated PIB-PAM-PIB and unborated mPAO-PAM-mPAO (component (iv)) with anti-wear components (i) and (ii), but without calcium salicylate detergent component (iii). Examples 11 and 15 contain the same general amounts of the same components but mixed using different component pre-blends. Examples 12 and 17 show mixtures of unborated mPAO-PAM-mPAO dispersant component (iv) and dihydrocarbyl phosphite component (v), without any of anti-wear components (i) and (ii) and calcium salicylate detergent component (iii) (and indeed without any detergent). Examples 13, 14, and 16 are roughly, but not exactly, the calcium salicylate component (iii) detergent-containing analogs of Examples 10, 11, and 15, including both anti-wear components (i) and (ii) and mixtures of unborated mPAO-PAM-mPAO dispersant component (iv) and borated PIB-PAM-PIB dispersant. Each of the mPAO and PIB arms/endcaps of both the mPAO-PAM-mPAO and PIB-PAM-PIB dispersants, respectively, used in the Comparative Examples and the Examples had number average molecular weights from 750 to 2500 Daltons, as determined by GPC with reference to linear polystyrene standards. Additionally, each PAM connector within both the mPAO-PAM-mPAO and PIB-PAM-PIB dispersants, respectively, used in the Comparative Examples and the Examples exhibited an average x (a polyalkyleneamine repeat unit value) from 3 to 10.

Each additive package/fully formulated composition from Tables 3-4 was characterized for KV40, and fully formulated compositions were tested for volume resistivity (reciprocal of volume conductivity) using a Baur DTLC apparatus/rig, commercially available from Baur GmbH of Sulz, Austria, and following the procedures outlined in ASTM D1169-11 (specifying ~80° C. and ~500V).

Each additive package/fully formulated composition from Tables 3-4 was also tested for needle-bearing fatigue (NBFT) lifetime. NBFT lifetime can be analyzed using various methods. Herein, a Falex 4-ball E/P wear test machine, commercially available from Falex of Sugar Grove, Ill. (USA), was adapted to test how a relatively small volume (~50 mL) of sample protected bearings from wear. In this adapted tester, a bearing (i.e., NSK part #AXK1105) capable of holding 30 roller bearings (oriented axially, as if around the numbers of a clock face) is modified by removing two out of every five bearings, such that three bearings in a row are seated, followed by the next two bearing slots absent, repeating six times (the three bearings in a row are oriented roughly at the even numbers on a clock face, i.e., 12, 2, 4, 6, 8, and 10, while the absent bearing slots are oriented roughly at the odd numbers on the same clock face, i.e., 1, 3, 5, 7, 9, and 11, respectively), such that 18 bearings are present and 12 empty bearing slots remain. This modified bearing is placed between an upper and a lower bearing race (i.e., NTN part #WS81105 and NSK part #FTRE-2542), respectively, and housed in a test cup containing a thermocouple to validate the sample temperature and an adapter to attach to the wear tester rig's spinning shaft, in which a heating means can be used to control sample temperature. In the needle-bearing fatigue test, the test machine shaft spins at ~2100 rpm, while a load is applied to the bearing assembly that is lubricated by the sample composition. For the first ~26 minutes of the test, a load of ~588 N is applied; for the next ~4 minutes, the load is increased to ~2940 N;

after ~30 minutes total, the load is further increased to ~8820 N for the remainder of the test. The first ~30 minutes of the test (when a relatively reduced load is applied) is considered the "break-in" period. In this test, the target temperature is nominally ~120° C., although the test begins at approximately room temperature (~20-25° C.). The heating means within the adapter provides some heat, but the target temperature need not be strictly attained typically, a temperature of at least ~100° C. is attained before the load is increased to ~8820 N. If desired, during the testing (but typically only after the break-in period), external air flow can be introduced to counteract frictional heat, so that the bearing thermocouple temperature does not overshoot/exceed ~120° C. for very long. The test is terminated only when a vibration threshold is reached. A vibration amplitude baseline is established at frequencies spanning from ~1 Hz to ~10 kHz at ~45 minutes after the break-in period (i.e., at ~75 minutes into the test). Excluding frequencies of ~176-654 Hz, ~1367-1426 Hz, and ~4.492-4.795 kHz, the remaining frequencies are monitored for vibration. For almost all other frequencies, the test is terminated when a vibration that is at least 250% above the baseline at that frequency is detected (i.e., the vibration amplitude is about 3.5 times, or ~350% of, the baseline amplitude when the vibration amplitude exceeds the baseline amplitude by ~250%). However, for vibration frequencies between ~2.3 kHz and ~2.4 kHz (from ~2305 Hz to ~2402 Hz), the test is terminated only when a vibration that is at least 125% above the baseline at that frequency is detected (i.e., the vibration amplitude is about 2.25 times, or ~225% of, the baseline amplitude when the vibration amplitude exceeds the baseline amplitude by ~125%). These vibrations are believed to be indicative of wear (e.g., pitting). Once the test is terminated, the bearing and its assembly are removed and visually inspected (often at magnification) for evidence of pitting. If there is absolutely no evidence of pitting upon visual inspection, the termination may have been premature, and the test may be excluded. Typically, needle-bearing fatigue (NBFT) lifetime represents an average of 4 to 7 measurements, but more or fewer measurements may be used. NBFT lifetime can be calculated in Megacycles (abbreviated "Mcyc" herein), utilizing the dimensions and geometry of the bearing parts and the shaft spinning rate, to assess a number of cycles per hour, and only the testing time when the lubricated bearings are subject to the full load (I.e., the post-break-in testing time, or the total testing time, in hours, minus the initial 30-minute break-in period).

It is clear from Tables 3-4 that neither the beneficial ~80° C. volume resistivity values (i.e., above a particular threshold value) nor the beneficial needle-bearing fatigue lifetime values (nor thus their combination) are inherent, even if a composition contains the combination of all of components (i), (ii), (iii), and (iv). For instance, as indeed shown in Examples 12 and 17, even a combination of components (iv) and (v), without any of components (i), (ii), and (iii), yielded highly beneficial VR values above the threshold of Comparative Example 18, although beneficial NBFT lifetime above the threshold of Comparative Example 18 was clearly not inherent (i.e., occurring in Example 17, but not in Example 12). Thus, combination of different components may or may not yield the simultaneous combination of VR values uniformly at or above 44.0 MΩ·m (e.g., with no single VR measurement at or above 46.0 MΩ·m) and average NBFT lifetime values at or above 13.0 Mcyc (or at or above 14.0 Mcyc). Further noteworthy is that Comparative Examples 8 and 9 show average VR values below the threshold and NBFT lifetime values above the threshold of Comparative Example 18, which is the same for Examples 10 and 13. However, directly the opposite, Examples 11 and 12 show average VR values above the threshold and NBFT lifetime values below the threshold of Comparative Example 18. Only Examples 14-17 achieve both average VR values and NBFT lifetime values above the threshold. Examples 14 and 16 contain all of components (i), (ii), (iii), and (iv), while Example 15 contains only components (i), (ii), and (iv) (no component (iii) nor indeed substantially any detergent whatsoever), and Example 17 contains only components (iv) and (v) (substantially no components (i), (ii), and (iii) and indeed substantially no PIB-based dispersant). There are many other possible interpretations to be gleaned from this data, but the non-inherency of the correlation between components and properties, particular VR and NBFT lifetime as discussed herein, is paramount.

What is claimed is:

1. A transmission fluid composition comprising:

a major amount of a lubricating oil basestock; and a minor amount of an additive package comprising:

(i) from 0.05 to 0.5 wt% of a mixture comprising two or more compounds of structures (I):

(I)

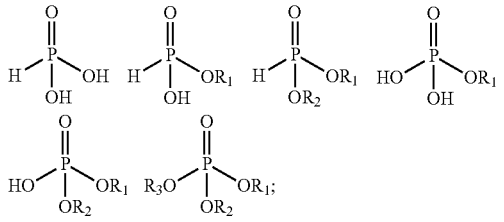

wherein groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms in which the alkyl chain is interrupted by a thioether linkage;

(ii) from 0.07 to 0.4 wt% of a compound of structure (II) comprising:

(II)

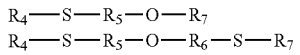

wherein groups $R_4$ and $R_7$ are independently alkyl groups having 1 to 12 carbon atoms and $R_5$ is an alkyl linkage having 2 to 12 carbon atoms;

(iii) a detergent comprising calcium salicylate; and (iv) a basic nitrogen-containing ashless dispersant comprising one or more compounds of structure (III):

(III)

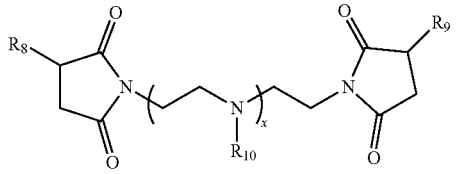

wherein:

$R_8$ and $R_9$ are each independently a hydrocarbon group made by the metallocene-catalyzed polymerization of an α-olefin feedstock consisting essentially of 1-octene, 1-decene, 1-dodecene, or mixtures thereof;

each $R_{10}$ is independently hydrogen, an acetyl moiety, or a moiety formed by reaction between ethylene carbonate and >N—$R_{10}$; and x is from 1 to 10 and is the same for all molecules of structure (III) or is an average of all molecules of structure (III) in a mixture of molecules of structure (III).

2. A transmission fluid composition according to claim 1, wherein the compounds of component (i) and component (ii) are present in the composition in a mass ratio of from 2:1 to 1:2.

3. A transmission fluid composition according to claim 1, wherein component (iii) is present in the composition in an amount from 0.05 to 0.7% by mass, based on the total mass of the composition.

4. A transmission fluid composition according to claim 1, wherein component (iii) provides the composition with 45 to 450 parts per million by mass (ppm) of calcium, based on the total mass of the composition.

5. A transmission fluid composition according to claim 1, wherein component (iii) comprises no intentionally added phenate detergent component and/or comprises no intentionally added sulfonate detergent component.

6. A transmission fluid composition according to claim 1, wherein component (iv) is present in the composition in an amount from 0.75 to 5.0% by mass, based on the total mass of the composition.

7. A transmission fluid composition according to claim 1, wherein, in structure (III):

each $R_{10}$ is independently hydrogen or an acetyl moiety; and x is from 3 to 10.

8. A transmission fluid composition according to claim 1, wherein $R_8$ and $R_9$ moieties of the ashless dispersant of component (iv) each independently has a number average molecular weight (Mn) from 300 to 20000 Daltons, as determined by GPC with reference to linear polystyrene standards.

9. A transmission fluid composition according to claim 1, further comprising an additional basic nitrogen-containing ashless dispersant of structure (IV):

(IV)

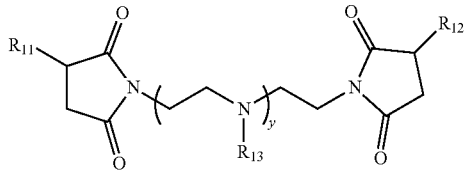

wherein:

$R_{11}$ and $R_{12}$ are each independently a hydrocarbyl group having a number average molecular weight (Mn) from 500 to 5000 Daltons, as determined by GPC with reference to linear polystyrene standards;

each $R_{13}$ is independently hydrogen, an acetyl moiety, or a moiety formed by reaction between ethylene carbonate and >N—$R_{13}$; and y is from 3 to 10 and is the same for all molecules of structure (IV) or is an average of all molecules of structure (IV) in a mixture of molecules of structure (IV).

10. A transmission fluid composition according to claim 9, wherein:

$R_{11}$ and $R_{12}$ are each independently a polyisobutenyl moiety having a number average molecular weight (Mn) from 750 to 2500 Daltons, as determined by GPC with reference to linear polystyrene standards; and each $R_{13}$ is independently hydrogen or an acetyl moiety.

11. A transmission fluid composition according to claim 1, further comprising substantially no other basic nitrogen-containing ashless dispersants other than component (iv).

12. A transmission fluid composition according to claim 1, wherein the composition comprises less than 100 parts per million by mass (ppm) of boron, based on the total mass of the composition.

13. A transmission fluid composition according to claim 1, wherein the lubricating oil basestock comprises a Group III basestock, a Group IV basestock, or a combination thereof.

14. A transmission fluid composition according to claim 1, further comprising a substituted thiadiazole, an aminic antioxidant, a phenolic antioxidant, a corrosion inhibitor, and a friction modifier having the following structure:

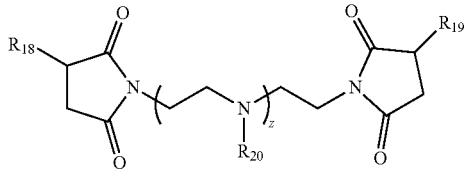

wherein each of $R_{18}$ and $R_{19}$ is independently:

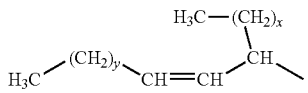

such that x+y is from 8 to 15 and z is an integer from 1 to 5; and wherein each $R_{20}$ is independently hydrogen, an acetyl moiety, or a moiety formed by reaction between ethylene carbonate and >N—$R_{20}$.

15. A transmission fluid composition according to claim 1, wherein:

the lubricating oil basestock exhibits a kinematic viscosity at 100° C. (KV100), as measured according to ASTM D445, from 1.5 cSt to 8.1 cSt;

the composition exhibits a KV100, as measured according to ASTM D445, from 2 cSt to 6.5 cSt;

the composition exhibits an average volume resistivity at about 80° C. of at least 46.0 MΩ·m; and the composition exhibits an average needle-bearing fatigue lifetime of at least 13.0 Megacycles.

16. A transmission fluid composition according to claim 1, wherein the composition exhibits an average volume resistivity at about 80° C. of at least 47.0 MΩ·m and an average needle-bearing fatigue lifetime of at least 14.0 Megacycles.

17. A transmission fluid composition according to claim 1, wherein the composition exhibits an average volume resistivity at about 80° C. of up to 95.0 MΩ·m and an average needle-bearing fatigue lifetime of up to 30.0 Megacycles.

18. A transmission fluid composition according to claim 1, wherein the composition exhibits an average volume resistivity at about 80° C. of up to 72.0 MΩ·m and an average needle-bearing fatigue lifetime of up to 25.0 Megacycles.

19. A method of controlling or reducing wear in a transmission powered by a hybrid electric or fully electric motor and simultaneously cooling at least a portion of electrical or electronic components of a hybrid electric- or fully electric-powered drivetrain, the method comprising lubricating the transmission and contacting one or more electrical or electronic components of the drivetrain with a transmission fluid composition according to claim 1.

20. A transmission fluid composition comprising:

a major amount of a lubricating oil basestock comprising a Group III basestock, a Group IV basestock, or a combination thereof; and a minor amount of an additive package comprising:

(iv) a basic nitrogen-containing ashless dispersant comprises one or more compounds of structure (III):

(III)

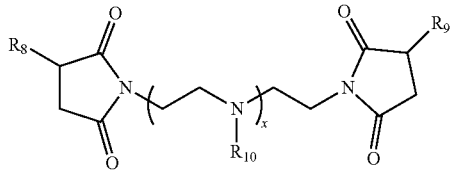

wherein:

$R_8$ and $R_9$ are each independently a hydrocarbon group made by the metallocene-catalyzed polymerization of an α-olefin feedstock comprising 1-butene, 1-pentene, 1-hexene, 1-heptene, 1-octene, 1-nonene, 1-decene, 1-undecene, 1-dodecene, 1-tetradecene, 1-octadecene, or mixtures thereof;

each $R_{10}$ is independently hydrogen, an acetyl moiety, or a moiety formed by reaction between ethylene carbonate and >N—$R_{10}$; and x is from 1 to 10 and is the same for all molecules of structure (III) or is an average of all molecules of structure (III) in a mixture of molecules of structure (III);

wherein component (iv) is present in the composition in an amount from 0.75% to 2.0% by mass, based on the total mass of the composition; and (v) one or more dihydrocarbyl hydrogen phosphite compounds having a structure H—P(=O)—$(OR_{39})_2$, in which each $R_{39}$ independently comprises an alkyl group having 12 to 24 carbon atoms, wherein component (v) provides the composition from 100 to 300 ppm by mass of phosphorous, based on the total mass of the composition; and wherein the transmission fluid composition comprises no intentionally added components of:

(i) a mixture comprising two or more compounds of structures (I):

(I)

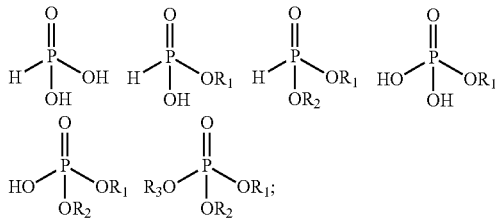

wherein groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in the mixture (i), at least some of groups $R_1$, $R_2$ and $R_3$ are alkyl groups having 1 to 18 carbon atoms in which the alkyl chain is interrupted by a thioether linkage;

(ii) one or more compounds of structures (II) of structures (II):

(II)

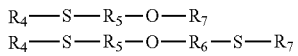

wherein groups $R_4$ and $R_7$ are independently alkyl groups having 1 to 12 carbon atoms and $R_5$ and $R_6$ are independently alkyl linkages having 2 to 12 carbon atoms;

(iii) a detergent comprising calcium salicylate; and (iv) a borated polyisobutenyl succinic anhydride (PIBSA)—polyamine (PAM) dispersant.

21. A transmission fluid composition according to claim 20, wherein, in structure (III):

the α-olefin feedstock consists essentially of 1-octene, 1-decene, 1-dodecene, or mixtures thereof;

each $R_{10}$ is independently hydrogen or an acetyl moiety; and x is from 3 to 10.

22. A transmission fluid composition according to claim 20, further comprising substantially no other basic nitrogen-containing ashless dispersants other than component (iv).

23. A transmission fluid composition according to claim 20, further comprising a substituted thiadiazole, an aminic antioxidant, a phenolic antioxidant, a corrosion inhibitor, and at least two friction modifiers, at least one of which having the following structure:

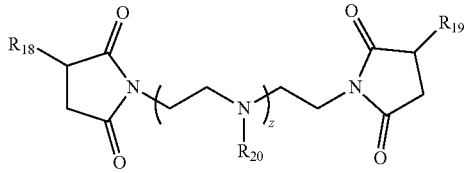

wherein each of $R_{18}$ and $R_{19}$ is independently:

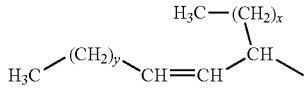

such that x+y is from 8 to 15 and z is an integer from 1 to 5; and wherein each $R_{20}$ is independently hydrogen, an acetyl moiety, or a moiety formed by reaction between ethylene carbonate and >N—$R_{20}$.

24. A transmission fluid composition according to claim 20, wherein:

the lubricating oil basestock exhibits a kinematic viscosity at 100° C. (KV100), as measured according to ASTM D445, from 1.5 cSt to 3.3 cSt;

the composition exhibits a KV40, as measured according to ASTM D445, from 9.1 cSt to 11.4 cSt;

the composition exhibits an average volume resistivity at about 80° C. of at least 46.0 MΩ·m; and the composition exhibits an average needle-bearing fatigue lifetime of at least 8.88 Megacycles.

25. A transmission fluid composition according to claim 20, wherein the composition exhibits an average volume resistivity at about 80° C. of up to 350 MΩ·m and an average needle-bearing fatigue lifetime of up to 22.0 Megacycles.

* * * * *